US005448282A

United States Patent [19]

Imai et al.

[11] Patent Number: 5,448,282

[45] Date of Patent: Sep. 5, 1995

[54] THERMAL TRANSFER PRINTING METHOD AND APPARATUS AND INTERMEDIATE SHEET

[75] Inventors: Akihiro Imai, Ikoma; Hiroyuki Matsuo, Neyagawa; Yasuo Fukui, Kadoma; Nobuyoshi Taguchi, Ikoma, all of Japan

[73] Assignee: Matsushita Electric Industrial Co., Ltd., Osaka, Japan

[21] Appl. No.: 95,176

[22] Filed: Jul. 23, 1993

[30] Foreign Application Priority Data

Jul. 23, 1992 [JP] Japan ..... 4-196707

[51] Int. Cl.[6] ..... B41J 2/32

[52] U.S. Cl. ..... 347/213; 347/221; 346/135.1; 503/227

[58] Field of Search ..... 346/1.1, 76 R, 76 PH, 346/135.1, 76 L; 400/120; 503/227; 347/213, 221

[56] References Cited

U.S. PATENT DOCUMENTS

| | | | |
|---|---|---|---|
| 4,844,770 | 7/1989 | Shiraishi et al. | 156/241 |
| 4,923,848 | 5/1990 | Akada et al. . | |
| 5,006,502 | 4/1991 | Fujimura et al. | 503/227 |
| 5,281,976 | 1/1994 | Imai et al. | 346/76 PH |
| 5,284,814 | 2/1994 | Taguchi et al. | 503/227 |
| 5,332,459 | 7/1994 | Imai et al. | 156/234 |

FOREIGN PATENT DOCUMENTS

| | | |
|---|---|---|
| 58-222877 | 12/1983 | Japan . |
| 4-131277 | 5/1992 | Japan . |
| 4-156385 | 5/1992 | Japan . |

*Primary Examiner*—Huan H. Tran
*Attorney, Agent, or Firm*—Wenderoth, Lind & Ponack

[57] ABSTRACT

A process for thermal transfer printing method including the steps of forming a thermal transfer image in a dyeing layer of an intermediate sheet using a coloring layer of a transfer sheet and transferring the dyeing layer carrying the formed image from the intermediate sheet to an image receptor with a medium for applying heat and/or pressure, in which the medium is also used for fixing the transferred dyeing layer on the image receptor, and an thermal transfer printing apparatus having means for feeding an elongate intermediate sheet having a dyeing layer, means for cutting the elongate intermediate sheet, printing means for forming a thermal transfer image in the dyeing layer of intermediate sheet, and means for transferring the dyeing layer carrying the formed thermal transfer image to an image receptor, by which the printed image with low gloss is formed on the image receptor at a high printing speed.

35 Claims, 9 Drawing Sheets

THERMAL TRANSFER PRINTING METHOD AND APPARATUS AND INTERMEDIATE SHEET

BACKGROUND OF THE INVENTION

1. Field of the Invention

The present invention relates to a thermal transfer printing method which uses a printing means such as a thermal head, an optical head or an electrical resistance head, an apparatus, and an intermediate sheet for thermal transfer printing. In particular, the present invention relates to a printing method having good performances in a sublimation type thermal transfer printing on a sheet of plain paper, an apparatus therefor, and an intermediate sheet for thermal transfer printing.

2. Description of the Related Art

In thermal transfer printing, an image is formed on an image receptor by laminating a transfer sheet having a coloring layer on the image receptor and transferring a color image from the transfer sheet directly onto the image receptor using a printing head. There is a method known for forming an image on the image receptor by forming an image on a separate intermediate sheet and then transferring the image from the intermediate sheet to the image receptor (see, for example, Japanese Patent Kokai Publication No. 222877/1983 and U.S. Pat. No. 4,923,848).

Among the thermal transfer printing methods using an intermediate sheet, the sublimation type thermal transfer printing requires an intermediate sheet having thereon a dyeing layer on which a dye is dyed or color developed. An image is formed on the image receptor by forming an image in the dyeing layer of the intermediate sheet and then transferring the dyeing layer carrying the formed image onto the image receptor.

The conventional image, which is formed by transferring the dyeing layer from the intermediate sheet to a sheet of plain paper, is high gloss, so that the formed image has an appearance and a hand feel like an image receptor which is formed by coating the dyeing layer on the sheet of plain paper. Therefore, the formed image has poor configurations as an image on the sheet of plain paper.

The dyeing layer on the intermediate sheet should be maintained on the intermediate sheet when the image is formed on the dyeing layer, while it should be removed from the intermediate sheet when it is transferred to the image receptor. However, no printing method has been developed which satisfies both properties and stably prints the image at a high speed.

When the intermediate sheet sheet is continuous, and a first part of the dyeing layer carrying the image of the intermediate sheet is transferred to the image receptor at the same time as another image is formed on a second part of the dyeing layer of the intermediate sheet, the first and second parts of the dyeing layer of the intermediate sheet should be simultaneously pressed by the head or other means. In addition, when all the colors are printed using a single head, the specific part of the intermediate sheet should be returned to the position of the head. In either case, to carry out the image forming and the image transfer simultaneously, the position of intermediate sheet should be controlled. Consequently, after the image is transferred, the next image forming should be done, which prolongs the total printing time.

When plural cut intermediate sheets are stacked in a sheet feeder, and a thin polymer film is used as a base material of the intermediate sheet, they tend to be wrinkled or to stick to each other in the sheet feeder, since the polymer film has less rigidity than paper. Accordingly, handling of the intermediate sheets is difficult when the plural cut intermediate sheets are stacked in the sheet feeder.

Further, a thermal transfer printing method and apparatus having a simple structure has been desired.

SUMMARY OF THE INVENTION

One object of the present invention is to provide a thermal transfer printing method which can print an image on a sheet of plain paper, which image has less gloss and no incompatibility between the plain paper surface and the transferred image.

Another object of the present invention is to provide a thermal transfer printing method which can easily print an image at a high speed.

A further object of the present invention is to provide an apparatus for thermal transfer printing which has a simple structure.

A yet further object of the present invention is to provide an intermediate sheet which is used in the thermal transfer printing.

A typical thermal transfer printing method according to the present invention uses a transfer sheet having a coloring layer thereon, an intermediate sheet having a dyeing layer thereon and an image receptor between the transfer sheet and the intermediate sheet an image is formed on the dyeing layer of the intermediate sheet, and the method then transfers the dyeing layer to the image receptor. A thermal and/or pressure medium for transferring the dyeing layer carrying the formed image to the image receptor is also used as a fixing medium for fixing the transferred dyeing layer on the image receptor.

A typical apparatus for thermal transfer printing according to the present invention comprises a means for feeding an elongate intermediate a sheet, means for cutting the elongate intermediate a sheet, means for thermally printing an image on the intermediate sheet using a transfer sheet, and a means for laminating the intermediate sheet having the formed image on an image receptor and transferring the image onto the image receptor.

The intermediate sheet according to the present invention comprises a substrate, a dyeing layer formed on the substrate and an image-fixing layer on the substrate or the dyeing layer.

DETAILED DESCRIPTION OF THE DRAWINGS

Figure 1:
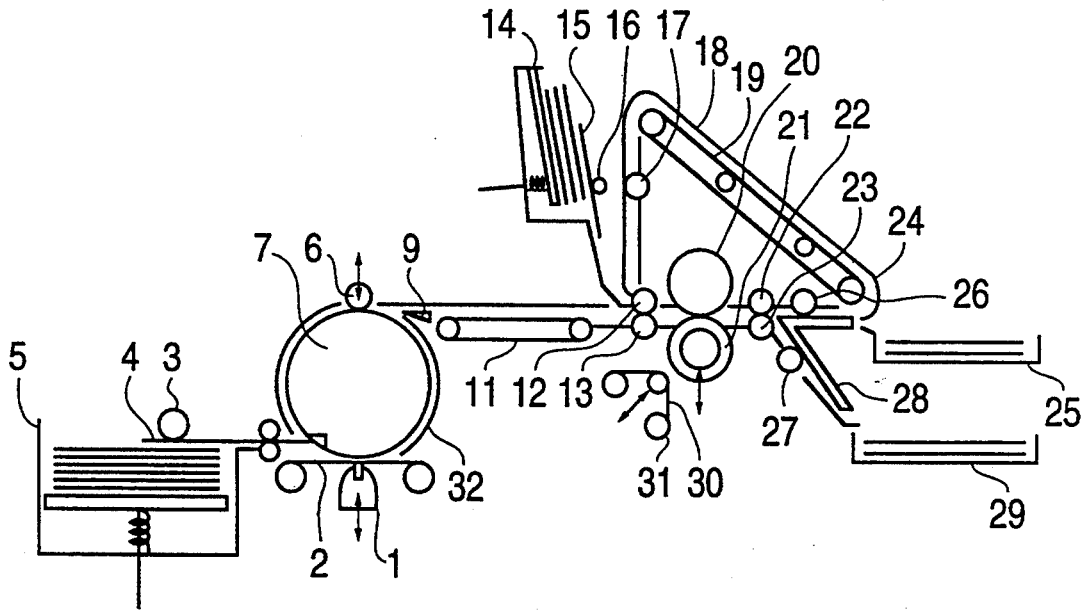
FIG. 1 schematically shows an embodiment of the thermal transfer printing method according to the present invention, FIG. 2 schematically shows a step for transferring a dyeing layer onto an image receptor in an embodiment of the thermal transfer printing method according to the present invention, FIGS. 3 to 9 schematically show various embodiments of the thermal transfer printing method according to the present invention, FIGS. 10 and 11 schematically show a step for transferring the dyeing layer onto the image receptor and fixing the dyeing layer in the thermal transfer printing method according to the present invention, FIGS. 12 and 13 schematically show a step for transferring the dyeing layer onto the image receptor and/or fixing the dyeing layer in the thermal transfer printing method according to the present invention.

FIG. 1 schematically shows a first embodiment of the thermal transfer printing method according to the present invention. Structures or arrangements of a transfer sheet and an image receptor, traveling systems, and the number and positions of a recording head, platens and rolls are not limited to those of FIG. 1.

In FIG. 1, an intermediate sheet having a dyeing layer (not shown) on a substrate is used as a typical example of the intermediate sheet.

Figure 2:
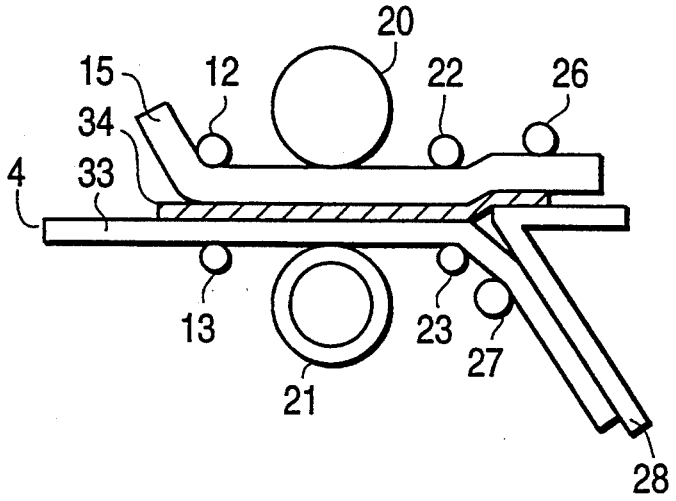

FIG. 2 is an enlarged view of the transfer section of the method of FIG. 1.

The first embodiment of the thermal transfer printing according to the present invention will be explained by making reference to FIGS. 1 and 2.

Each intermediate sheet 4 having a dyeing layer on its lower surface is fed from an intermediate sheet-feeder 5 to a platen 7 by a feeding roll 3.

In FIG. 1, the intermediate sheet 4 is held on the platen 7 with with a chuck provided on the peripheral surface of the platen 7. However it can be held on the platen in various ways, such as an electrostatic or mechanical manner; by a sticking agent (e.g., a low sticking agent comprising a releasing silicone resin and a tacky silicone resin); by a suction force suctioning the intermediate sheet from the inside of the platen; by a sprocket by providing a hole in the intermediate sheet; by rolls holding both edges of the intermediate sheet; or by rolls provided around the periphery of the platen. To hold and release the intermediate sheet, it is possible to provide an electrification mechanism or a deelectrification mechanism. When a front edge of the intermediate sheet is made thicker than the other parts thereof, the intermediate sheet is easily held by the chuck and the like.

In FIG. 1, a guide 32 is opened at a position where the platen faces a printing head 1. When the intermediate sheet tends to be easily ejected outside through the opening, the opening can be closed by the recording head 1 and a transfer sheet 2 to prevent the ejection of the intermediate sheet and so that the intermediate sheet is firmly held on the platen. Alternatively, the opening is closed by the guide 32 when the intermediate sheet is held on the platen and opened in a printing step.

The transfer sheet 2 comprises a substrate and a coloring layer (not shown) on the substrate. In other figures, the coloring layer of the transfer sheet or the dyeing layer of the intermediate sheet may not be shown for clarity. But the transfer sheet and the intermediate sheet always have the coloring layer and the dyeing layer, respectively. The coloring layer is formed on a surface of the transfer sheet opposite to a surface to which the recording head contacts.

The transfer sheet 2 and the intermediate sheet 4 are laminated so that the coloring layer of the transfer sheet and the dyeing layer of the intermediate sheet are contacted with each other between the printing head 1 and the platen 7, and the printing head 1 is pressed towards the platen 7. Then, the laminated transfer sheet and intermediate sheet travel along with the rotation of the platen 7 while recording signals are applied to the printing head 1 to record a thermal transfer image in the dyeing layer of the intermediate sheet 4. In this seep, the transfer sheet and the intermediate sheet may travel at the same speed, or at different speeds, i.e. at relative to each other speeds.

When a second color is printed using a single recording head, the dyeing layer carrying the already recorded image of the first color is laminated, by rotating the platen, with a coloring layer of the transfer sheet having the second color, for example a second coloring layer of a transfer sheet having plural coloring layers. Then, the image of the second color is printed in the dyeing layer of the intermediate sheet in the same manner as above. In the same way, third and subsequent color images can be printed in the dyeing layer of the intermediate sheet.

The platen may consist of a heating roll. For example, when the platen consists of a rubber-coated heating roll having an internal heater such as a halogen lamp therein, the recording sensitivity is significantly improved, so that the recording speed can be greatly increased in comparison with a platen having no heater with the same recording energy being applied to the recording head.

After printing the image or images in the dyeing layer of the intermediate sheet, the transfer sheet 2 can be moved along with the intermediate sheet 4 around the periphery of the platen 7 to cool down the coloring layer of the transfer sheet. Then the transfer sheet 2 is delaminated from the intermediate sheet 4, so that the dyeing layer of the intermediate sheet is transferred less to the coloring layer of the transfer sheet so that the image is stably printed on the intermediate sheet.

After recording, a separating nail 9 is contacted with the platen 7 or moved close to the platen, and the intermediate sheet 4 is removed from the platen 7 by rotating the platen clockwise and forwarding the intermediate sheet 4 on a conveying belt 11.

A surface of the intermediate sheet opposite to the surface having the dyeing layer may have an antistatic layer, a releasing layer, an anti-skid layer or a lubricating layer. The surface of the platen may also have such a layer.

The intermediate sheet on the conveying belt 11 is laminated on an image receptor 15 which is fed from an intermediate sheet feeder 14 using a feed roll 16. The laminated intermediate sheet 4 and the image receptor are passed through a pair of driving rolls 12 and 13 and heated and/or pressed so that the dyeing layer having the printed image is removed from the intermediate sheet 4 and transferred to the image receptor 15.

In FIG. 1, the intermediate sheet 4 and the image receptor 15 are supplied between a heating roll 20 and a silicone rubber heating roll 21 and then passed through a pair of rolls 22 and 23. Thereafter, the image receptor and the intermediate sheet are separated by a separation guide 28 having a driving roll 26 and a driving roll 27 respective sides thereof.

The dyeing layer on the intermediate sheet is transferred to the image receptor when the substrate of intermediate sheet is separated from the image receptor by the separation guide 28 after the laminated intermediate sheet and image receptor are passed through the rolls 22 and 23. A substrate 33 of intermediate sheet is separated on the side of the driving roll 27 and discharged in a tray 29.

FIG. 2 shows an enlarged view of the above transfer step.

When the laminated intermediate sheet 4 and image receptor 15 are inserted between the heating roll 20 and the silicone rubber heating roll 21 under pressure, without trueing up the front edges of the intermediate sheet and the image receptor, for example, when they are laminated, as shown in FIG. 2, so that the front edge of the intermediate sheet first reaches the area between the driving rolls 12 and 13, the substrate 33 of the intermediate sheet and the image receptor are easily separated, since the front edges of the intermediate sheet and the image receptor reach the separation guide with a time lag.

When a dyeing layer 34 is not formed over the whole surface of the intermediate sheet 4 but, as shown in FIG. 2, on a part of the substrate 33, the substrate 33 of intermediate sheet 4 and the image receptor 15 are easily separated by the separation guide 28, since the front edge part of the intermediate sheet is not adhered to the front edge part of the image receptor by the dyeing layer.

The substrate of the intermediate sheet and the image receptor can be separated by any means that can separate them, such as a separation nail, a separation roll, or an electrostatic separation method, as long as they are separated.

After separating the intermediate sheet from the platen 7, the intermediate sheet and the image receptor may be directly passed through the heating roll 20 and the silicone rubber heating roll 21 without conveying the intermediate sheet wiht the belt 11.

The dyeing layer may be transferred from the intermediate sheet to the image receptor by separating the image receptor from the intermediate sheet when the laminated intermediate sheet and image receptor are cooled to a lower temperature than their temperature just after they pass through the heating roll 20 and the silicone rubber heating roll 21, for example, when they pass through the pair of rolls 22 and 23 as shown in FIG. 2, or they may be separated when they are still hot just after passing through the heating roll 20 and the silicone rubber heating roll 21. In either case, the dyeing layer having the printed image is transferred to the image receptor by a medium for applying heat and/or pressure.

Alternatively, after passing the laminated intermediate sheet and image receptor through the heating roll 20 and the silicone rubber heating roll 21, they may be forced cooled and separated to transfer the dyeing layer to the image receptor.

The state in which the laminated intermediate sheet and image receptor are cooled to a lower temperature than their temperature just after they pass through the heating roll 20 and the silicone rubber heating roll 21 is intended to mean that the temperature of the laminated intermediate sheet and image receptor is cooled to a temperature at most 20° C. higher than a glass transition temperature of the dyeing layer of the intermediate sheet (or a layer to be transferred), or to a temperature at which the dyeing layer does not suffer from cohesive failure in the transfer step.

In the transfer step, the whole or a part of the dyeing layer may be transferred from the intermediate sheet to the image receptor.

When the intermediate sheet and the image receptor are still hot just after passing through the heating roll 20 and the silicone rubber heating roll 21 and separated, it is preferred to use an intermediate sheet having a releasing layer which may contain a tackifier and/or fine particles between the dyeing layer and the substrate.

In FIG. 1, when heat and/or pressure is further applied on the image receptor carrying the transferred dyeing layer, the dyeing layer is fixed to the image receptor and the image is formed on the image receptor.

In FIG. 1, the image receptor carrying the transferred dyeing layer is conveyed to an entrance between the driving rolls 12 and 13 by a conveying belt 19 and a driving roll 17, passed through the driving rolls 12 and 13, and then inserted between the heating roll 20 and the silicone rubber heating roll 21, whereby the dyeing layer is fixed. When the image receptor is reinserted between the heating roll 20 and the silicone rubber heating roll 21, the intermediate sheet, which is in the form of a cut sheet, has already been discharged to the tray 29. The dyeing layer on the image receptor is then directly contacted with to the surface of the silicone rubber heating roll 21, whereby the dyeing layer is fixed on the image receptor by an elastic surface having surface releasability of the silicone rubber heating roll 21. The fixed image receptor is passed through the pair of rolls 22 and 23 and a driving roll 26. Then, a guide 24 is opened so that the image receptor is discharged into a tray 25 for collecting the image receptors on which the image is formed.

As the conveying belts 11 and 19, a paper-conveying belt which is used in a copying machine can be used. For example, a rubber belt comprising a cloth in which a rubber is impregnated may be used.

The dyeing layer transferred from the intermediate sheet so the image receptor may be fixed in a different manner from the above. For example, after the dyeing layer is transferred to the image receptor and the substrate of intermediate sheet is passed through the rolls 22 and 23, the image receptor carrying the transferred dyeing layer may be passed through the rolls 22 and 23 in the direction reverse to the direction in which the image receptor is passed in the transfer step and returned between the heating roll 20 and the silicone rubber heating roll 21 under pressure, whereby the dyeing layer is fixed on the image receptor by the heating roll 20 and the silicone rubber heating roll 21. The fixed image receptor can be discharged on the left side of the heating roll 20 and the silicone rubber heating roll 21 by providing a discharging exit on that side. The fixed image receptor may be conveyed by the driving roll 17 and the conveying belt 19 and discharged into the tray 25 opening the guide 24. Alternatively, the fixed image receptor is again passed through the rolls 22 and 23 and on the roll 26 and discharged into the tray 25.

FIG. 1 uses the conveying belt for conveying the image receptor having the transferred dyeing layer, but any conveying mechanism which can return the image receptor to the position of the heating roll 20 and the silicone rubber heating roll 21 for fixing may be used. For example, an air flow conveying system, a negative or positive air pressure conveying system or a moving (rubber) roll may be used. As the intermediate sheet 4 is held on the platen, the image receptor 15 can be held on the heating roll 20 and then the dyeing layer may be transferred to and fixed on the image receptor by rotating the roll 20.

In FIG. 1, when the intermediate sheet having the dyeing layer on which the thermally transferred image is printed and the image receptor 15 are passed through the heating roll 20 and the silicone rubber heating roll 21 under pressure, they are laminated in a manner so that a part of the front edge of the intermediate sheet extends beyond the front edge of the image receptor, and then they are passed between the heating rolls 20 and 21 to integrate them together and are removed from the rolls 20 and 21, or from the rolls 22 and 23. In the latter case, the separation guide 28 is not necessary.

After removal, in the integrated intermediate sheet and image receptor, at least a part of the front edge of the intermediate sheet extends beyond the front edge of the image receptor, whereby the extended part of the front edge of the intermediate sheet is held by fingers, and the intermediate sheet is removed from the integrated image receptor, so that the dyeing layer carrying the printed image is transferred to the image receptor.

When the intermediate sheet and the image receptor are laminated to leave a grasping margin at the front edge of the intermediate sheet, the intermediate sheet can be easily delaminated either manually or mechanically. When the intermediate sheet is delaminated mechanically, it can be grasped mechanically, while it may also be delaminated using a separation nail such as the separation guide as shown in FIG. 1. The grasping margin is effective in prarticular when the thickness of the intermediate sheet is 30 $\mu$m or less.

The grasping margin may be present on the front edge of the intermediate sheet as above, or on a side edge of the intermediate sheet.

While the method of FIG. 1 uses cut intermediate sheets, it is possible to use an elongate intermediate sheet as shown in FIGS. 4 to 9. In the case of an elongate intermediate sheet, the sheet is cut at any time in the printing step so that the sheet is cut part of the intermediate sheet may have the grasping margin. It is possible to cut the intermediate sheet after laminating it on the image receptor.

After manually or mechanically delaminating the substrate of the intermediate sheet from the image receptor and transferring the dyeing layer having the thermal transferred image to the image receptor, the image receptor carrying the dyeing layer is passed between the heating roll 20 and the silicone rubber heating roll 21 under pressure while contacting the dyeing layer to the silicone rubber heating roll 21, whereby the dyeing layer is fixed on the image receptor.

When a sheet of paper is used as the image receptor and the dyeing layer is fixed in spaces among paper fibers to obtain a printed image having a greatly suppressed gloss, it is important to use, as a medium for applying heat and/or pressure which contacts the dyeing layer on the image receptor, an elastic material such as a silicone rubber roll or an elastic roll having a small adhesion to or a good releasability from the dyeing layer when the heat and/or pressure are applied.

Wrinkle-preventing means may be provided to prevent wrinkling in the transfer and fixing steps of the image receptor between the heating roll and the silicone rubber heating roll. For example, when the image receptor is traveling between the pair of driving rolls 12 and 13 and the pair of heating rolls 20 and 21, the rotating speed of the driving rolls 12 and 13 is adjusted in relation to the rotating speed of the heating rolls 20 and 21 to apply a tension to the image receptor to prevent wrinkling. It may be possible to provide a stretcher roll, such as a barrel type roll, upstream of the heating roll and the silicone rubber heating roll. The heating roll and the silicone rubber heating roll themselves may serve as stretcher rolls.

The temperature or pressure of the heating roll 20 or the silicone rubber heating roll 21 may be different between the transfer step and the fixing step.

With the heating roll 20, the silicone rubber heating roll 21, the platen 7 or other rolls, a cleaning apparatus may be attached. For example, in FIG. 1, the silicone rubber heating roll 21 is continuously or intermittently cleaned with a cleaning tape 30 wound round a roll 31. As the cleaning tape, a nonwoven fabric, a woven fabric, or a nonwoven fabric containing a lubricant such as a silicone oil is preferred. The cleaning apparatus may be a device for supplying a small amount of a releasing agent to the silicone rubber heating roll 21.

In FIG. 1 and the subsequent figures, the positions of the printing head, platen, heating roll, silicone rubber heating roll, and other rolls may be changed according to the traveling conditions of the transfer sheet, the intermediate sheet or the image receptor, or the printing conditions. For example, the heating roll 20 and the silicone rubber heating roll 21 are pressurized and contacted with each other in the transfer and fixing steps, while they may be in a non-contact state in other steps.

Marks to be provided on the transfer sheet, the intermediate sheet, the image receptor and the like, and position sensors therefor are not shown in the figures, and they may be provided, if necessary. In addition, the apparatus of the figures may include other necessary rolls, means for adjusting traveling of the intermediate sheet, means for adjusting traveling of the image receptor, temperature sensors, temperature controllers, etc.

When plural printing heads are used in the apparatus of FIG. 1, each color can be printed with each of the printing heads, which are provided around the periphery of the platen, whereby the total printing speed is much increased. A single transfer sheet and the plural printing heads can be used around the platen, while plural transfer sheets and plural printing heads are combined and provided around the platen. On one platen, plural intermediate sheets may be held and printed.

In the thermal transfer printing method according to the present invention, any printing head may be used insofar as an image is formed in the dyeing layer of the intermediate sheet by sublimating or diffusing a coloring agent of the coloring layer on the transfer sheet. Examples of the printing head are a thermal head, an optical head or an electrical resistance head.

A manner of applying heat and/or pressure to the image receptor and the intermediate sheet, or to the image receptor carrying the dyeing layer is not limited insofar as the dyeing layer is transferred from the intermediate sheet to the image receptor or is fixed on the image receptor.

For example, the laminated intermediate sheet and image receptor are, or the image receptor having the transferred dyeing layer is, passed through a pair of media which are under the pressure of, for example, a spring, electromagnetic pressure or air pressure, or which can be pressed, and at least one of which is heated, or a pair of media under high pressing pressure or a light source having a large radiation heat.

As the medium, a roll, a flat plate, a heat resistant film, a film or sheet-form elastic material, or a thermal printing head can be used. Preferably, a surface of the medium has releasability.

Any type of heating source such as a halogen lamp, a nichrome wire, a conductive film and the like can be used.

Preferred examples of the medium are rubber rolls (e.g., silicone rubber rolls, fluororubber rolls, polyurethane rubber rolls, etc.), plastic rolls, metal rolls, polytetrafluoroethynlene-coated rolls, and the like. The elastomers used in the rubber rolls include natural and synthetic rubbers, such as chloroprene rubber, isoprene rubber, butyl rubber, butadiene rubber, nitrile-butadiene rubber, tetrafluoroethylene-propylene rubber, acrylic rubber, epichlorohydrin rubber, styrene-butadiene rubber, hydrogenated nitrile rubber, polysulfide rubber, etc. The rigidity of the rubbers may be suitably adjusted.

The media may be used in combination. For example, the elastic roll, such as the silicone rubber roll (e.g., a rubber-coated metal roll), may be used along with a metal roll or another elastic roll. Alternatively, one of the pair of media is a roll or a heating roll, while the other of the pair is a heating medium of a other form (e.g., a heating plate, a light source having a large radiation heat, a heating film, etc.), or a heated medium.

In particular, when the dyeing layer is fixed on the image receptor, the use of an elastic medium such as the elastic roll on the dyeing layer side will form a printed image having a greatly reduced gloss on the image receptor. Preferably, an elastomer having a low rubber rigidity, for example, 50° or lower, is used. Preferably, the surface of the elastic material has a releasability against a layer to be transferred, such as the dyeing layer on which the image is printed, in particular, when the layer to be transferred is softened or molten.

The elastic material of the elastic roll may contain additive particles such as carbon, white carbon, red oxide, etc., and/or a colorant or pigment.

As the elastic material, there may be used various thermoplastic elastomers such as polyurethane, polyester, polyolefin, polystyrene, polyamide, fluoropolymer and the like.

When the thermal printing head such as a thermal head or a conductive head is used as one of the media, a necessary part of the layer to be transferred, for example, an area of the dyeing layer having the printed image, can be transferred and/or fixed selectively.

The heating temperature is not critical. Usually, the heating temperature is from ambient temperature to 300° C., preferably from ambient temperature to 250° C., and in particular from ambient temperature to 200° C. The pressure is not critical either. Usually, the pressure is not higher than $10^9$ Pa.

FIG. 1 shows the combination of the heating (metal) roll and the silicone rubber heating roll as the media. The combination of the media is not limited to this one in the present invention. This is the same as in the subsequent figures.

Figure 3:
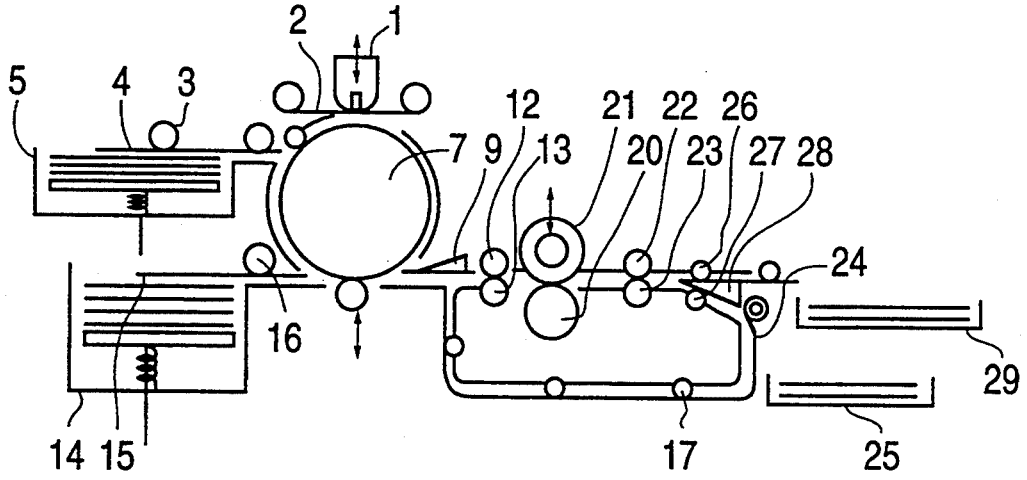

FIG. 3 schematically shows a second embodiment of the thermal transfer printing method according to the present invention. The principle of the method of FIG. 3 is substantially the same as that of FIG. 1.

The intermediate sheet and the image receptor are supplied to a printing section from its left side, and the printed image receptor and the substrate of the used intermediate sheet, which may carry the dyeing layer when a part of the dyeing layer has been used, are discharged from the right side of the printing section.

The intermediate sheet 4 is fed from the intermediate sheet feeder 5 by the feeding roll 3 to the platen 7. The intermediate sheet can be held on the platen 7 in the same manner as in FIG. 1. For example, in FIG. 3, a layer of tacky material of, for instance, 20 to 200 g/12 cm is applied on a part of the peripheral surface of the platen, and the front edge part of the intermediate sheet is held by the tacky material.

After laminating the coloring layer of the transfer sheet 2 on the dyeing layer of the intermediate sheet, the printing head 1 is pressed towards the platen 7. Then, the recording signals are applied to the printing head 1 to form the thermal transfer image in the dyeing layer. Second and subsequent color images can be printed in the same way as in the method of FIG. 1.

The image receptor 15 is separately fed from the image receptor feeder 14 by the feeding roll 16 to the entrance of the driving rolls 12 and 13, and stands by there.

The intermediate sheet which has been thermally printed is removed from the platen 7 by the separating nail 9, forwarded to the entrance of the driving rolls 12 and 13, and laminated on the image receptor 15. Then, the laminated intermediate sheet and image receptor are conveyed to the heating roll 20 and the silicone rubber heating roll 21 by the driving rolls 12 and 13. After passing the heating rolls 22 and 23, the dyeing layer of the intermediate sheet is transferred to the image receptor, and the substrate of intermediate sheet is delaminated from the image receptor carrying the transferred dyeing layer by the separation guide 28. The substrate of The intermediate sheet is discharged in the tray 29.

After the separation from the substrate of intermediate sheet, the image receptor is passed over the driving rolls 27 and 17 and returned to the entrance of the driving rolls 12 and 13. Then, the image receptor is again passed through the heating roll 20 and the silicone rubber heating roll 21, so that the dyeing layer is fixed on the image receptor. The fixed image receptor is passed through the rolls 22 and 23 and the driving roll 27, and discharged to the image receptor tray 25 by opening the guide 24.

Figure 4:
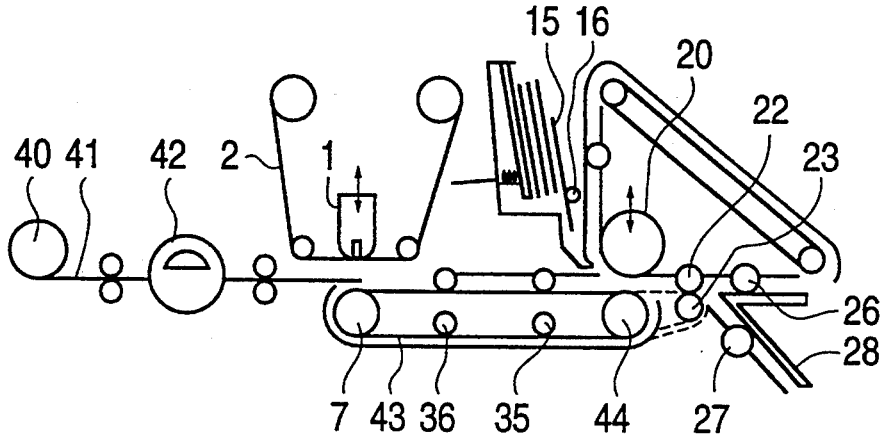
Figure 5:
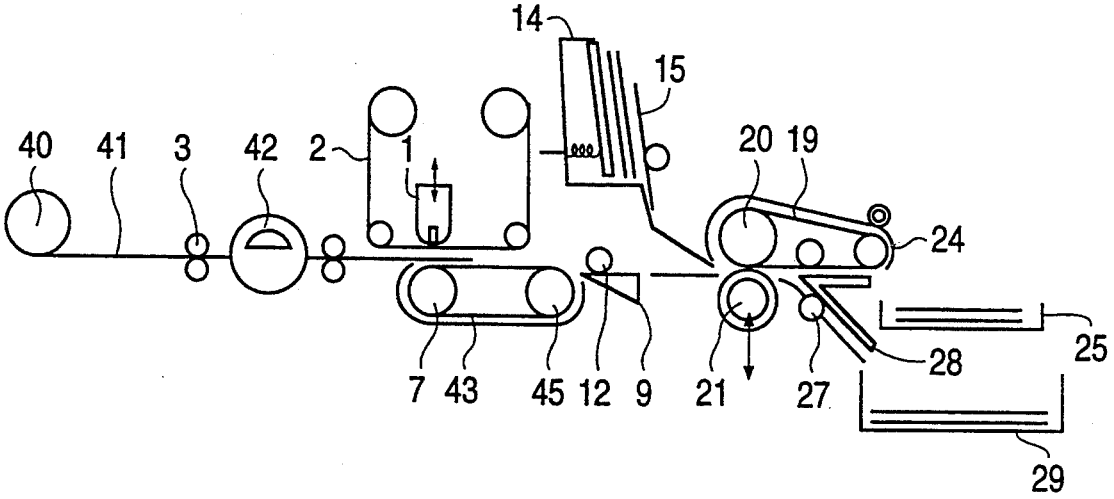
Figure 6:
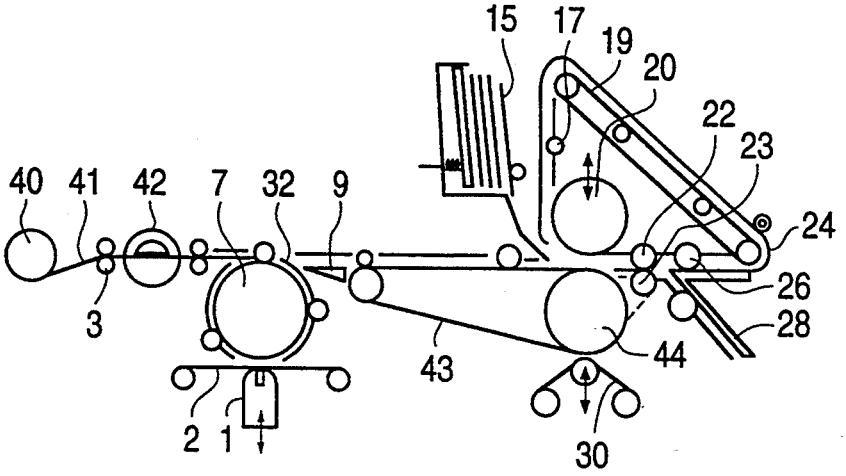

FIGS. 4, 5 and 6 schematically show further embodiments of the thermal transfer printing method according to the present invention.

In FIGS. 4 and 5, an intermediate sheet 41 is held on or contacted with a-rotating belt 43 instead of holding the intermediate sheet on the platen, and the thermal transfer image is formed in the dyeing layer of the intermediate sheet.

Since the dyeing layer should be removed from the substrate of intermediate sheet and transferred to the image receptor, it cannot be firmly adhered to the substrate of intermediate sheet. As a result, then The sublimation type thermal transfer image is printed in the dyeing layer of the intermediate sheet, since the coloring layer of the transfer sheet and the dyeing layer of the intermediate sheet are softened or molten, the dyeing layer may tend to be transferred to the coloring layer of the transfer sheet. When the image is printed while holding the intermediate sheet on the rotating belt, the intermediate sheet and the transfer sheet can be delaminated after the coloring layer and the dyeing layer are sufficiently cooled after the sublimation type thermal transfer image is printed in the dyeing layer of the intermediate sheet. When the intermediate sheet is delaminated from the transfer sheet after sufficient cooling, the dyeing layer is not transferred to the coloring layer of the transfer sheet.

In the usual thermal transfer printing, to prevent the transfer of the dyeing layer to the coloring layer, a dyeing layer is firmly adhered to the substrate of intermediate sheet by applying a prime or anchor coat on the surface of the substrate. However, when the dyeing layer should be transferred to the image receptor, the intermediate sheet cannot have the prime coat. It is then advantageous to print the thermal transfer image on the intermediate sheet which is being held on the belt. The cooling of the intermediate sheet after printing is accelerated by holding it on the belt.

The construction of FIG. 5 is particularly effective, in which, after printing the image in the dyeing layer of the intermediate sheet with the printing head, the transfer sheet 2 and the intermediate sheet 41 on the rotating belt 43 are conveyed while keeping them in contact with each other, and after cooling the coloring layer and the dyeing layer the intermediate sheet and the transfer sheet are delaminated.

In particular, when the cut intermediate sheet is held on the rotating belt and the image is printed, the printing speed is increased, and the image is stably printed since the dyeing layer is not transferred to the coloring layer.

Since the rotating belt is present between the printing head and the platen, it preferably has elasticity, or it has an elastic layer thereon, in view of printing sensitivity or the improvement of the image quality when the thermal transfer image is printed in the dyeing layer of the intermediate sheet.

In FIG. 1, when a large size image is printed on the intermediate sheet, the diameter of the platen should be made large, and then the apparatus should be enlarged. When the rotating belt is used as shown in FIGS. 4 and 5, it is not necessary to use a large platen, and the whole size of the apparatus can be made small.

In FIG. 4, after printing the thermal transfer image on the intermediate sheet, the rotating belt also serves as a forwarding belt for conveying the intermediate sheet to the next transfer section, namely a beaming roll 20 and a heating roll 44. In addition, on the heating roll 44, the rotating belt has the transfer and fixing mechanisms. When the rotating belt has elasticity or the elastic layer thereon, it accelerates the injection of the dyeing layer into the spaces among the paper fibers of the paper made image receptor by the elasticity, when the dyeing layer is transferred to and fixed on the image receptor.

Preferably, the surface of rotating belt has releasability against the transferred layer such as the dyeing layer transferred to the image receptor.

As explained in connection with FIG. 1, the heating rolls 20 and 44 may both be heating rolls, while also only one of them may be a heating roll. The heating roll 20 is not always contacted with the rotating belt 43, and is contacted with the rotating belt when the dyeing layer is transferred to or fixed on the image receptor.

As shown by a broken line in FIG. 4, the rotating belt 43 may be in the form of a belt connecting the platen 7 and a roll 23 (the same as in FIG. 6).

In FIG. 5, after printing the thermal transfer image on the intermediate sheet, the rotating belt serves as a forwarding belt for conveying the intermediate sheet to the next transfer section, namely the heating roll 20 and the silicone rubber heating roll 21. Since a roll 45 is provided independently from a roll for transferring the dyeing layer, the belt is not heated in the dyeing layer-transfer section, unlike FIG. 4, so that it is possible to prevent the influence of heat in the dyeing layer-transfer section on the thermal transfer printing section. Since the next printing step can by carried out while the dyeing layer is being transferred to the image receptor, the printing speed can be increased. In FIG. 5, the conveying belt for the image receptor 15 is wound around the heating roll 20. The dyeing layer having the printed image can be transferred to the image receptor by holding the image receptor on the conveying belt 19.

In FIG. 6, the rotating belt 43 has the function of a forwarding belt for conveying the intermediate sheet after image printing and also a transfer or fixing function at the position of the heating roll 44. Like the method of FIG. 5, the method of FIG. 6 can remove the influence of heat on the dyeing layer-transfer section and increase the printing speed.

While the cleaning means is explained in connection with FIG. 1, it is possible to assemble cleaning means with the rotating belt 43. For example, as in FIG. 1, a cleaning tape 30 can be provided in the apparatus of FIG. 6, and the rotating belt can be cleaned by the cleaning tape 30.

In connection with the methods of FIGS. 4, 5 and 6, the following explanation will be made by making reference to FIG. 4 as a representative embodiment.

The elongate intermediate sheet 42 fed from an unwinding roll 40 is cut to a suitable length by a cutter 42, and supplied between the printing head 1 and the platen 7. The front edge of the cut intermediate sheet is held on the rotating belt around the platen 7 by an electrostatic force or the like. In this embodiment, any of the methods for holding the intermediate sheet on the platen as explained in connection with FIG. 1 may be employed.

After adjusting the positions of the transfer sheet and the intermediate sheet by a position sensor or the like so that the coloring layer of the transfer sheet is laminated on the dyeing layer of the intermediate sheet, the printing head 1 is pressed towards the platen 7. Thereby, the thermal transfer image is printed in the dyeing layer while rotating the platen 7, the heating roll 44 and the rotating belt 43. When a second color image is to be printed in the dyeing layer in which the first color image has been printed, the intermediate sheet is returned between the printing head and the platen by rotating the totaling belt in the clockwise direction. Then, the positions of the intermediate sheet and the second coloring layer of the transfer sheet are adjusted to each other by the position sensor, and the second color image is thermally transfer printed in the dyeing layer. The third and subsequent colors can be printed in the same manner as above.

The elongate intermediate sheet may be cut by the cutter 42 before or after it is held on the rotating belt 43. The elongate intermediate sheet may be cut before, during or after the thermal transfer printing of the image in the dyeing layer. For example, the elongate intermediate sheet 41 may be cut by the cutter 42 after the first color is printed, or after two or more colors are printed.

When plural colors are printed, they may be printed on the same part of the dyeing layer or different parts of the dyeing layer.

When two or more colors are printed, the second or subsequent color may be printed while returning the intermediate sheet around the unwind roll 40 or after completely winding the intermediate sheet around the unwind roll 40 and then unwinding it again.

After conveying the intermediate sheet with the rotating belt to the entrance of the heating roll 20 and the roll 44 and laminating it on the image receptor 15, the laminated intermediate sheet and image receptor are passed through the heating roll 20 and the roll 44 to transfer the dyeing layer to the image receptor 15.

When the intermediate sheet and the image receptor are being passed through the heating roll 20 and the roll 44, the rolls are under pressure.

Thereafter, the dyeing layer which has been transferred from the intermediate sheet to the image receptor is fixed on the image receptor in substantially the same manner as in the method of FIG. 1, except that the rotating belt 43 is present between the roll and the image receptor in FIG. 4.

Figure 10:
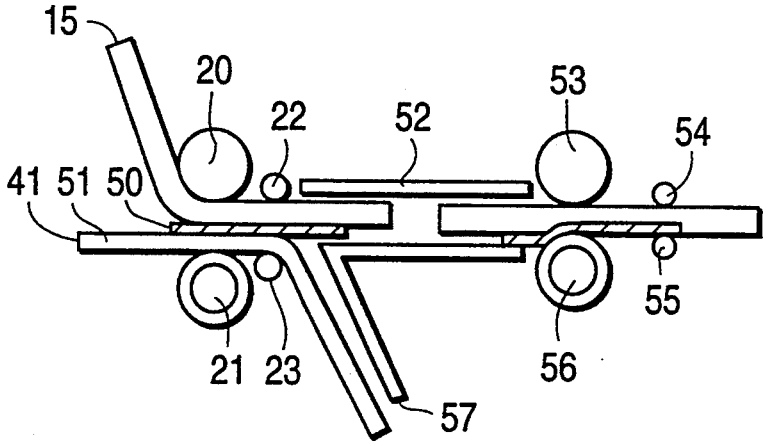

The dyeing layer may be fixed on the image receptor in the method shown in FIGS. 10 or 11, which will be explained hereinafter.

A yet further embodiment of the thermal transfer printing method according to the present invention will be explained by making reference to FIG. 7.

Figure 7:
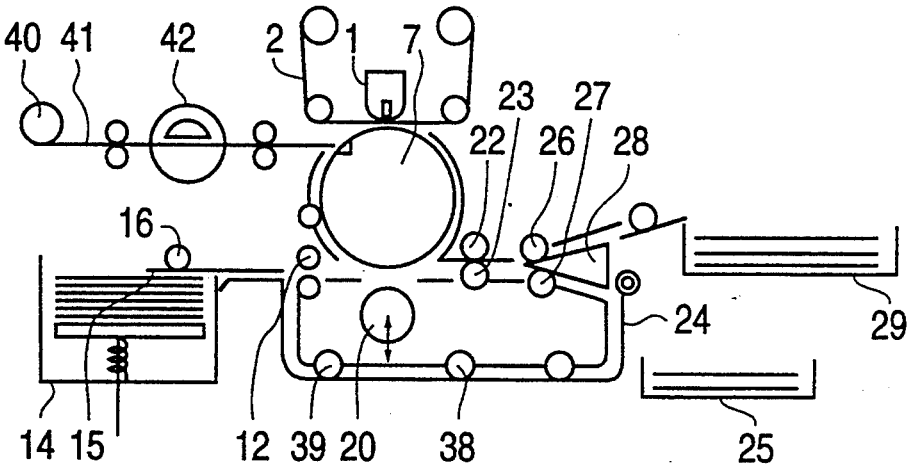

In FIG. 7, the elongate intermediate sheet 41 which has been fed from the unwind roll 40 is cut by the cutter 42 to a suitable length, and held on the platen 7. The elongate intermediate sheet 42 may be cut at any step in the image printing process as explained in connection with FIG. 4. The cut intermediate sheet held on the platen 7 is laminated with the coloring layer of the transfer sheet 2, and the thermal transfer image is printed in the dyeing layer of the intermediate sheet using the printing head.

After printing the image, the dyeing layer is transferred from the substrate of intermediate sheet to the image receptor using the platen as one of the media for applying heat and/or pressure. That is, after printing the image in the dyeing layer, the image receptor 15 fed from the image receptor feeder 14 is registered with the intermediate sheet, in particular, an end edge of the intermediate sheet which is not held by the chuck of the platen before inserting them between the platen 7 and the heating roll 20, or the former is registered with the latter between the platen 7 and the heating roll 20. Then, the heating roll 20 is pressed towards the platen 7, and the intermediate sheet and the image receptor are passed between the heating roll 20 and the platen 7 while rotating them. In this step, the intermediate sheet is detached from the chuck of the platen. After the intermediate sheet and the image receptor are passed through the rolls 22 and 23 and cooled to a temperature at which the dyeing layer does not suffer from cohesive failure, the substrate of intermediate sheet is delaminated from the image receptor by the separation guide 28, whereby the dyeing layer is transferred to the image receptor. The substrate of intermediate sheet is discharged into the tray 29. Alternatively, after printing the image in the dyeing layer of the intermediate sheet, the intermediate sheet and the image receptor are passed through the heating roll 20 and the platen 7 under pressure, and immediately after passing the roll 20 and the platen 7, they are separated to transfer the dyeing layer to the image receptor. When the intermediate sheet and the image receptor are separated immediately after they are passed through the roll 20 and the platen 7, it is preferred to use an intermediate sheet having, between the substrate and the dyeing layer, a releasing layer (or a releasing layer containing a sticking agent and/or fine particles) which does not cause the cohesive failure in the dyeing layer when the dyeing layer is transferred to the image receptor. When the intermediate sheet and the image receptor are separated immediately after they pass the roll 20 and the platen 7, the separation guide is provided immediately downstream of the heating roll 20 and the platen 7.

The image receptor carrying the as-transferred dyeing layer is discharged in the image receptor tray 25 by opening the guide 24. When the dyeing layer is to be fixed on the image receptor, the image receptor carrying the transferred dyeing layer is passed over the driving rolls 38 and 39 and again through the heating roll 20 and the platen 7 under pressure. The fixed image receptor is the discharged in the tray 25 by opening the guide 24.

In this embodiment, since the platen 7 is used as one of the media for applying heat and/or pressure, the explanations made regarding media for applying the heat and/or pressure in connection with FIG. 1 are relevant to the combination of the heating roll 20 and the platen 7.

The platen 7 is preferably a rubber-coated roll, for example, a silicone rubber-coated roll which has good releasability against the dyeing layer of the intermediate sheet. The platen 7 may be a heating roll having a built-in halogen lamp.

FIGS. 4 to 9 show the embodiments of the thermal transfer printing method according to the present invention, in which the elongate intermediate sheet is cut.

The method of cutting the elongate intermediate sheet shown in each of FIGS. 4 to 7 has already been explained in connection with FIG. 4.

Figure 8:
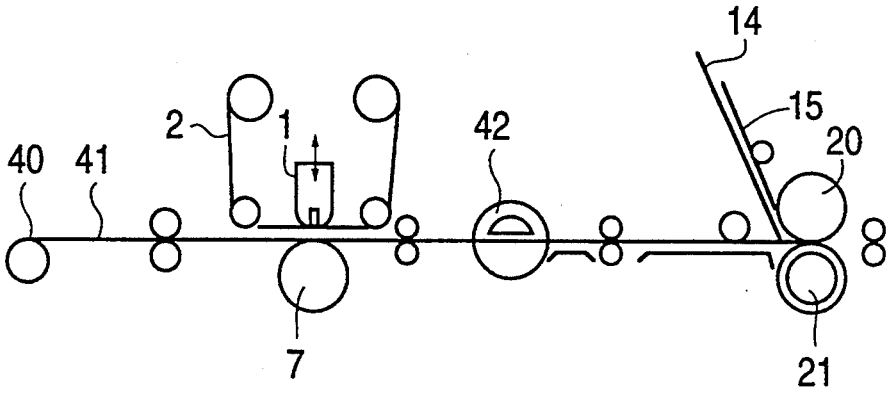

Now, the embodiment of FIG. 8 will be explained.

The elongate intermediate sheet 41 fed from the unwinding roll 40 is combined with the transfer sheet 2, and they are then pressed between the printing head 1 and the platen 7 to print the thermal transfer image of at least one color in the dyeing layer of the intermediate sheet. Thereafter, a part of the intermediate sheet on which the image is printed is cut from the elongate intermediate sheet by the cutter 42, and the cut part of the intermediate sheet is used in the subsequent printing steps. This embodiment includes a case where the part of the elongate intermediate sheet is cut during transfer of the dyeing layer to the image receptor between the heating roll 20 and the silicone rubber heating roll 21. As already explained, the heating roll 20 and the silicone rubber heating roll 21 may be used as the fixing section. The heating roll 20 and the silicone rubber heating roll 21 may have the structures shown in FIG. 10 or 11.

The embodiment of FIG. 9 will be explained.

The elongate intermediate sheet 41 fed from the unwinding roll 40 is combined with the transfer sheet 2, and they are then pressed between the printing head 1 and the platen 7 to print the thermal transfer image of at least one color in the dyeing layer of the intermediate sheet. Thereafter, the elongate intermediate sheet having the dyeing layer on which the image is printed is passed through the heating roll 20 and the silicone rubber heating roll 21 in the transfer section, and thereafter, the substrate of intermediate sheet is separated from the image receptor 15 by the separation guide 28, whereby the dyeing layer is transferred to the image receptor 15. After transfer, the intermediate sheet is cut by the cutter 42 or 49.

When the elongate intermediate sheet is cut before or during the transfer of the dyeing layer, since the cut intermediate sheet is discharged after the dyeing layer is transferred by the heating roll 20 and the silicone rubber heating roll 21, no intermediate sheet is present between the heating roll and the silicone rubber heating roll in the fixing step, so that the dyeing layer transferred to the image receptor is directly contacted with the surface of the silicone rubber heating roll 21 and fixed on the image receptor.

In the case of an image receptor which is porous, such as a paper image receptor, and/or one which has unevenness on its surface, when the dyeing layer is fixed on the image receptor by direct contact of the silicone rubber heating roll with the image receptor, the unevenness of the paper surface is absorbed by the elasticity of the silicone rubber so that the dyeing layer is easily injected in the spaces among the paper fibers, and the printed image has a very low gloss. Due to the releasability of the silicone rubber roll surface, the dyeing layer is not retransferred to the roll surface, so than the fixing of the dyeing layer provides the low gloss image.

If the substrate of the intermediate sheet is present between the heating roll 20 and the silicone rubber heating roll 21 after the transfer of the dyeing layer to the image receptor, the gloss on the substrate surface is reflected on the gloss of the dyeing layer and the gloss of the dyeing layer is not decreased, since the dyeing layer transferred to the image receptor contacts the substrate surface on the silicone rubber heating roll 21 in the fixing step.

Figure 9:
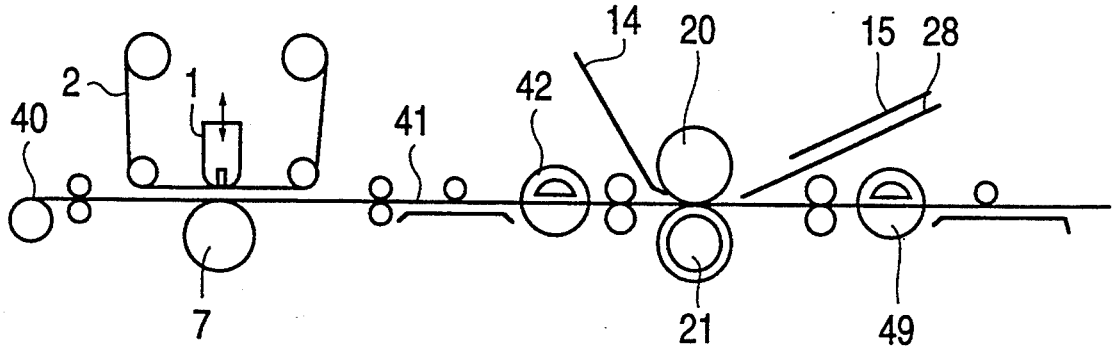

In the method of FIG. 9, when the elongate intermediate sheet is cut by the cutter 42, the cut intermediate sheet is discharged from the area of the heating roll 20 and the silicone rubber heating roll 21 so that the dyeing layer can be fixed on the image receptor in the absence of the intermediate sheet.

When the elongate intermediate sheet is cut by the cutter 49, and the dyeing layer is fixed on the image receptor, the elongate intermediate sheet is rewound on the unwind roll 40, whereby the dyeing layer is fixed on the image receptor in the absence of the intermediate sheet between the heating roll 20 and the silicone rubber heating roll 21.

As explained above, when the elongate intermediate sheet is used and cut in the printing step, the media for applying heat and/or pressure which are used in the transfer step can also be used in the fixing step of the dyeing layer. When the elongate intermediate sheet is cut, the transfer step and the fixing step can be carried out at the same time. For example, while the dyeing layer is transferred from a first part of the intermediate sheet to the image receptor, or it is fixed on the image receptor, a subsequent image is printed on a second part of the intermediate sheet. As a result, the printing speed as a whole is very much increased.

Since the elongate intermediate sheet is stored in the feeder, it is possible to prevent feeding of plural sheets at one time, which is one of the problems found in the use of cut intermediate sheets, so that the feeding of elongate intermediate sheet is easier than using cut intermediate sheets. In the case of the elongate intermediate sheet, it is possible to use a thin film as the substrate of the intermediate sheet, since the above problem is avoided, and the production cost can be decreased.

Now, the embodiments of FIGS. 10 and 11 will be explained, which illustrate sections for transferring the dyeing layer to the image receptor and fixing the dyeing layer on the image receptor.

When the dyeing layer is transferred from the intermediate sheet to the image receptor and fixed on the image receptor, transfer and fixing of the dyeing layer can be carried out in separate sections. That is, in FIG. 10 the dyeing layer 50 is transferred from the intermediate sheet 41 to the image receptor 15 by passing the intermediate sheet 41 and the image receptor 15 between the heating roll 20 and the silicone rubber heating roll 21 under pressure. After transfer, the image receptor 15 is passed between a heating roll 53 and a silicone rubber heating roll 56 under pressure to fix the dyeing layer on the image receptor. When the image receptor is made of a porous material such as a sheet of paper, the dyeing layer is injected into the spaces among paper fibers, so that an image having a suppressed gloss can be obtained.

Figure 11:
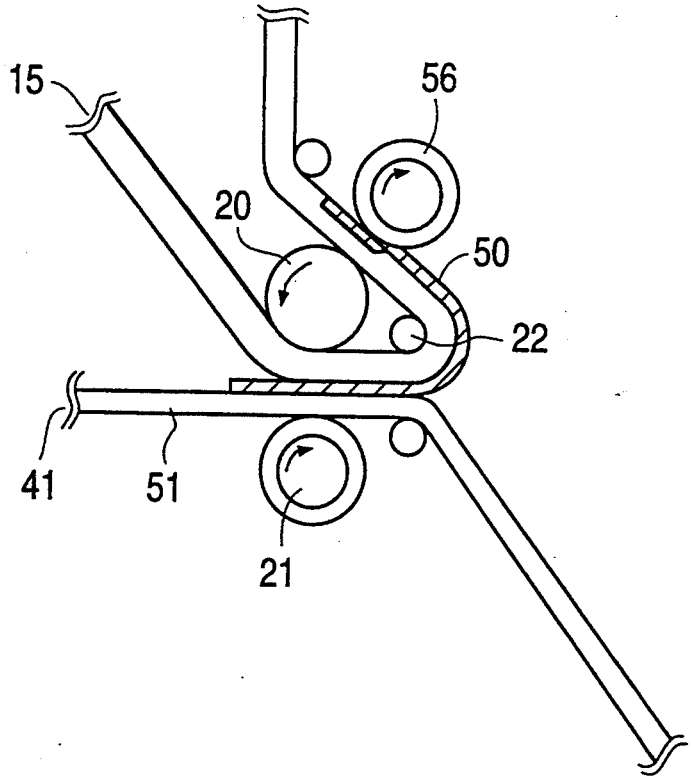

In FIG. 11, the heating roll 20 is used in the transfer section and also in the fixing section, since the number of the rolls is increased if the rolls for transfer and the rolls for fixing are separately provided. That is, in FIG. 11, the heating roll 20 and the silicone rubber heating roll 21 are used for transferring the dyeing layer to the image receptor, while the heating roll 20 and the silicone rubber heating roll 56 are used for fixing the dyeing layer on the image receptor.

When the intermediate sheet 41 and the image receptor 15 are passed between the heating roll 20 and the silicone rubber heating roll 21 under pressure, the dyeing layer 50 is transferred from the substrate of intermediate sheet 41 to the image receptor 15. Further, the image receptor carrying the transferred dyeing layer 50 is passed between the heating roll 20 and the silicone rubber heating roll 56, thereby fixing the dyeing layer on the image receptor 15.

After passing through the heating roll 20 and the silicone rubber heating roll 21, the image receptor 15 may travel over the surface of the roll 20 and be directly inserted between the heating roll 20 and the silicone rubber heating roll 56 without passing over the roll 22.

Figure 12:
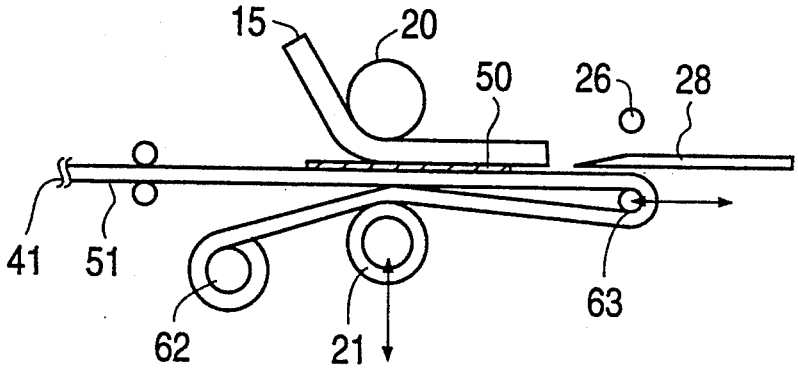

The embodiment of FIG. 12 will be explained, which shows a part of the thermal transfer printing method according to the present invention.

The intermediate sheet 41 has the dyeing layer 50 on the substrate 51. FIG. 12 only illustrates the process after the image is printed in the dyeing layer of the intermediate sheet, and does not show the printing section for thermal transfer printing of the image in the dyeing layer 50 using the transfer sheet. The printing of the thermal transfer image can be done in the same way as explained in connection with FIG. 1.

After printing the thermal transfer image in the dyeing layer 50 of the intermediate sheet 41, the intermediate sheet 41 and the image receptor 15 are laminated so that the dyeing layer 50 contacts the receiving surface of the image receptor, are passed between the heating roll 20 and the silicone rubber heating roll 21 under pressure. Then, the substrate 51 of the intermediate sheet 41 is delaminated from the image receptor 15 by the separation guide 28, whereby the dyeing layer 50 is transferred to the image receptor 15.

Thereafter, the silicone rubber heating roll 21 is lowered to widen the distance between the heating roll 20 and the silicone rubber heating roll 21. Then, a moving roll 63 is moved close to a wind-up roll 62 to avoid the presence of the intermediate sheet between the heating roll 20 and the silicone rubber heating roll 21. The image receptor 15 carrying the transferred dyeing layer 50 is again passed between the heating roll 20 and the silicone rubber heating roll 21 to fix the dyeing layer on the image receptor.

The embodiment of FIG. 13 will be explained, which also shows a part of the thermal transfer printing method according to the present invention.

An intermediate sheet 60 carries a dyeing layer 50 and a fixing layer 61 at different parts. FIG. 13 only illustrates the process after the image is printed in the dyeing layer of the intermediate sheet, while it does not show the printing section for thermal transfer printing of the image in the dyeing layer 50 using the transfer sheet. The printing of the thermal transfer image can be done in the same way as explained in connection with FIG. 1.

After printing the thermal transfer image in the dyeing layer 50 of the intermediate sheet 60, the intermediate sheet 60 and the image receptor 15 are laminated so that the dyeing layer 50 contacts the receiving surface of the image receptor, and are passed between the heating roll 20 and the silicone rubber heating roll 21 under pressure. Then, the substrate of the intermediate sheet 60 is delaminated from the image receptor 15 at the separation section between the rolls 22 and 23, whereby the dyeing layer 50 is transferred to the image receptor 15.

The image receptor 15 carrying the transferred dyeing layer 50 is returned to the entrance of the heating roll 20 and the silicone rubber heating roll 21, and the fixing layer 61 is then laminated with the dyeing layer carried on the image receptor 15. They are again passed between the heating roll 20 and the silicone rubber heating roll 21 to fix the dyeing layer on the image receptor, whereby a printed image having a suppressed gloss is obtained.

The gloss of the dyeing layer on the image receptor is greatly decreased by the application of heat and/or pressure through the fixing layer of the intermediate sheet.

Preferably, the surface of the fixing layer has releasability against the dyeing layer transferred to the image receptor.

The fixing of dyeing layer may be carried out by the manner as already explained in connection with FIGS. 10 or 11, in which the fixing section is separately provided. In such cases, the intermediate sheet is travels to the fixing section.

In the above embodiments, the cut or elongate intermediate sheet which has the dyeing layer and the fixing layer on the substrate may be used. When the elongate intermediate sheet is used, it can be cut at any step of the printing process.

In the above embodiments, the combination of the heating roll and the silicone rubber heating roll is used. However, it is possible to use any other combination of the media as explained in connection with FIG. 1.

When the thermal transfer image is formed in the dyeing layer of the intermediate sheet using the transfer sheet having plural coloring layers, such as a cyan coloring layer, a magenta coloring layer and a yellow coloring layer, the color image is formed on a single dyeing layer using the plural coloring layers, or a discrete image of each color is formed on each of the dyeing layers using a respective coloring layer. In the latter case, the dyeing layers are successively transferred to the intermediate sheet to form the plural or full color image.

In addition to the dyeing layer and/or the fixing layer, the intermediate sheet may have other layers such as a polymer layer, a UV light-absorber layer or a topcoat layer. In this case, it is possible to laminate various layers on the image receptor or an intermediate medium by superposing the dyeing layer having no image over the dyeing layer having the image, or superposing the UV light absorber layer on the dyeing layer having the printed image, or superposing the polymer layer on the dyeing layer having the printed image of a single color, or repeating the above superposing steps. When the intermediate medium is used, the laminated layers are transferred to the image receptor.

When the transfer sheet has a pigment ink layer as the other layer, the pigment ink layer can be printed on the substrate of intermediate sheet or the dyeing layer by the printing, head and then transferred to the image receptor or the already transferred dyeing layer. Alternatively, the pigment ink layer can be printed in a dyeing layer which is already transferred to the image receptor. Thereby, a sublimation type image and a melting type image are formed on the image receptor as above. When the transfer layer is fixed on the image receptor, a good image can be formed on the image receptor.

In the embodiments of FIGS. 1 to 12, the intermediate sheet has the dyeing layer on The substrate. The intermediate sheet may comprise a laminate of the polymer layer and the dyeing layer; a laminate of a releasing layer and the dyeing layer; a laminate of the releasing layer, the polymer layer and the dyeing layer; a laminate of the fixing layer and the dyeing layer; or a laminate of the fixing layer, the polymer and the dyeing layer. With such intermediate sheets, the image can be printed in substantially the same manner as described above.

The releasing layer may be an elastic releasing layer, or it may contain a sticking agent. An elastic layer may be formed between the substrate and the releasing layer.

When the intermediate sheet has the laminate of the polymer layer and the dyeing layer, the whole laminate is removed from the substrate of intermediate sheet and transferred to the image receptor. When the intermediate sheet has the laminate of the releasing layer and the dyeing layer, only the dyeing layer is separated at the interface between the releasing layer and the dyeing layer and transferred to the image receptor. When the intermediate sheet has the laminate of the releasing layer, the polymer layer and the dyeing layer, the laminate of the polymer layer and the dyeing layer is separated at the interface between the releasing layer and the polymer layer and transferred to the image receptor. When the intermediate sheet has the laminate of the fixing layer and the dyeing layer, only the dyeing layer is separated at the interface between the fixing layer and the dyeing layer and transferred to the image receptor. When the intermediate sheet has the laminate of the fixing layer, the polymer layer and the dyeing layer, the laminate of the polymer layer and the dyeing layer is separated at the interface between the fixing layer and the polymer layer and transferred to the image receptor.

When the elastic layer is formed between the substrate and the releasing layer, the dyeing layer or the laminate of the polymer layer and the dyeing layer is separated at the interface with the releasing layer.

The term "transferring the dyeing layer from the substrate of the intermediate sheet to the image receptor as" herein used is intended to include a case where the dyeing layer is separated from the releasing layer and transferred to the image receptor when the releasing layer is present between the substrate and the dyeing layer.

Figure 13:
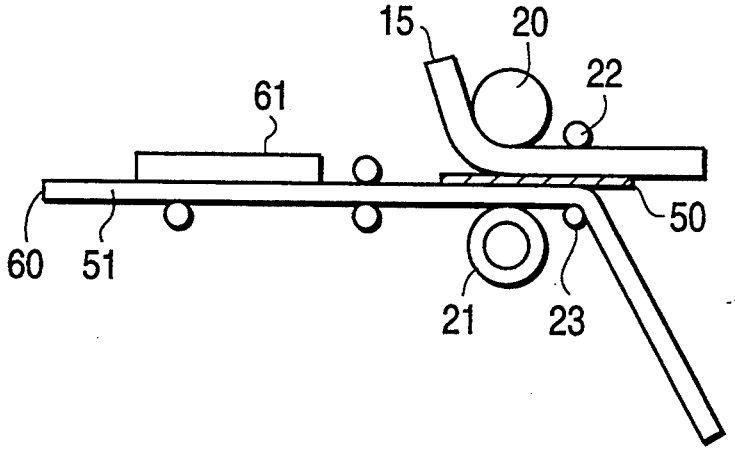

In FIG. 13, the intermediate sheet has the dyeing layer and the fixing layer on the different parts, but it is possible to use any one of the above described intermediate sheets.

Figure 14:
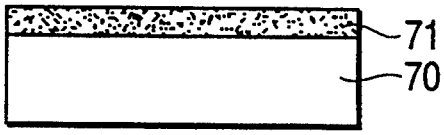
FIGS. 14 and 15 show cross sectional views of two embodiments of the transfer sheet to be used in the thermal transfer printing method of the present invention.
Figure 15:
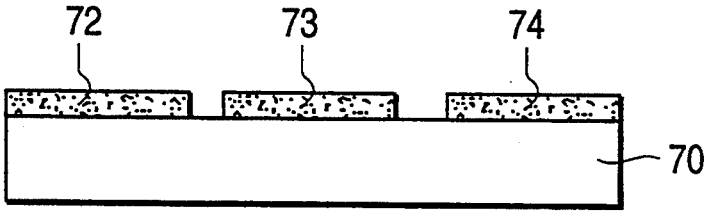
Figure 16:
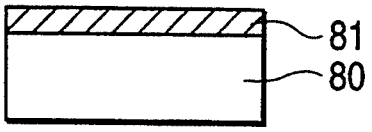
FIGS. 16 to 23 show cross sectional views of various embodiments of an intermediate sheet according to the present invention.

FIGS. 14 and 15 show cross sections of the transfer sheets to be used in the thermal transfer printing method according to the present invention.

The transfer sheet comprises a substrate 70 and a coloring layer 71. In FIG. 15, the transfer sheet has plural coloring layers, for example, a cyan coloring layer 72 containing a dye which provides the cyan color, a magenta coloring layer 73 which provides a magenta color, and a yellow coloring layer 74 which provides a yellow color at different parts. The transfer sheet may have a black coloring layer comprising a black dye or a mixture of plural color dyes. The transfer sheet may have a marker or markers for detecting the position or positions of the coloring layer or layers.

The substrate of the transfer layer may be made of any material. Examples of the substrate material are polymer films, surface treated (surface coated) polymer films, or conductive films. Examples of the polymer are polyolefins, polyamides, polyesters, polyimides, polyethers, cellulose, polyparabanic acid, polyoxadiazoles, polystyrene, fluoropolymers, and the like. In particular, polyethylene terephthalate, polyethylene naphthalate, aramide, triacetylcellulose, polyparabanic acid, polysulfone, polypropylene, cellophane, damp-proof cellophane and polyethylene are preferred.

Preferably, at least one surface of the substrate of the transfer sheet has a heat resistant layer, a lubricating layer, a lubricating conductive layer, a lubricating heat resistant layer, or a lubricating heat resistant conductive layer, since the heat resistance of the substrate is improved or the traveling stability of the sheet over the printing head is increased.

Preferably, a polymer film or conductive film having an adhesive or anchor coat layer on a side contacting the coloring layer is used as the substrate of the transfer sheet to prevent the removal of the coloring layer during the printing step.

As the conductive film, a polymer film containing conductive particles such as carbon black or metal powders, a polymer film having a conductive coating layer, a polymer film having a vacuum deposited conductive layer, and the like can be used.

The coloring layer 71 comprises a colorant and a binder. The kind of colorant is not limited. Examples of the colorant are disperse dyes, basic dyes, color formers, and the like. As the binder, various resins can be used. Examples of the binder resin are acrylic resins, polystyrene resins, polyurethane resins, polyester resins, polyvinyl acetal resins, polyvinyl acetate resins, chlorinated resins, polyamide resins, cellulose resins, and the like. The cellulose resins include methylcellulose, ethylcellulose, hydroxyethylcellulose, carboxymethylcellulose, nitrocellulose, cellulose acetate, and the like. In particular, when at least one binder resin selected from the group consisting of acrylonitrile-styrene copolymers, polystyrene, styrene-acryl copolymers, saturated polyesters, polyester-urethane, polyvinyl chloride, chlorinated polyvinyl chloride, vinyl chloride-vinyl acetate copolymers which may include an other copolymerizable monomer such as vinyl alcohol, maleic acid, etc., vinyl chloride-acrylate copolymer which may comprise two or more acrylates, polyvinyl acetate, chlorinated rubbers, chlorinated polypropylene, polycarbonate, cellulose resins and polyvinyl acetal, the printing speed is high, and/or the thermal fusion to the dyeing layer is effectively prevented.

The copolymer resin may comprise three or more comonomers. In particular, when polyvinyl acetal such as polyvinyl formal, acetacetalated polyvinyl alcohol, propionacetalated polyvinyl alcohol or polyvinyl butyral, which will be explained in connection with the dyeing layer, is used as the binder resin in the coloring layer or in the dyeing layer of the intermediate sheet, the thermal fusion between the coloring layer and the dyeing layer is highly prevented.

Among the binder resins, one having a glass transition temperature of 40° to 150° C., one having an average polymerization degree of 150 to 3000, or one having a flow softening temperature (a temperature at which flow of a polymer starts) of 80° to 350° C. is particularly preferred. The flow softening temperature is measured by a flow tester at a heating rate of 6° C./min. and a pressure of $9.80665\times10^6$ Pa using a die of 1 mm in diameter and 10 mm in length.

When the coloring layer comprises a colorant, a binder resin and at least one moisture-curing resin selected from the group consisting of fluorine-containing moisture-curing resins and siloxane-containing moisture-curing resins, the image can be printed on the intermediate sheet without fusion bonding of the transfer sheet and the intermediate sheet, since such moisture curing resin has excellent releasability.

As the fluorine-containing moisture-curing resin or the siloxane-containing moisture-curing resin, there are used a moisture-curing resin having hydrolyzable silyl group as disclosed in Japanese Patent Application No. 144241/1988 and a moisture-curing resin having hydrolyzable isocyanate group, to either of which a fluorine atom or a silicone group is introduced.

Examples of the fluorine-containing moisture-curing resin are fluorine-containing resins having hydrolyzable silyl group for instance, the moisture-curing resins disclosed in Japanese Patent Kokai Publication Mo. 558/1987. In particular, fluorine-containing acrylsilicone resins, and fluorine-containing polyurethane resins having hydrolyzable isocyanate group at chain ends or in side chains, are useful.

A typical example of the siloxane-containing moisture-curing resin is a siloxane-containing vinyl polymer having a hydrolyzable group. In particular, siloxane-containing acrylsilicone resins, and siloxane-containing polyurethane resins having a hydrolyzable isocyanate group at chain, ends or in side chains, are preferred.

The fluorine-containing or siloxane-containing acrylsilicone resin may be modified with a polyurethane resin.

An example of a commercially available fluorine-containing acrylsilicone resin is a fluorine-containing acrylsilicone resin solution (F-2A manufactured by Sanyo Chemical Industries, Ltd.). An example of commercially available siloxane-containing acrylsilicone resin is a siloxane-containing acrylsilicone resin (F-6A manufactured by Sanyo Chemical Industries, Ltd.). An example of a commercially available siloxane-containing moisture-curing resin having the hydrolyzable isocyanate group is a siloxane-containing moisture-curing resin solution (SAT-300 P manufactured by Shinko Technical Research Co., Ltd.)

The coloring layer may contain a reaction accelerator for the moisture-curing resin, if desired. Examples of the reaction accelerator are titanates, amines, organic tin compounds, acidic compounds, such as metal salts of carboxylic acids (e.g., alkyl titanate salts, metal salts of tin octylate, dibutyltin dilaurate, dibutyltin maleate, etc.), amine salts (e.g., dibutylamine 2-hexoate), and catalysts disclosed in Japanese Patent Kokai Publication No. 19361/1983.

An amount of the reaction accelerator is from 0.001 to 100% by weight based on the weight of the resin.

When the moisture-curing resin is used in the form of a paint, a storage stabilizer is optionally added. Examples of the stabilizer are disclosed in Japanese Patent Kokai Publication Nos. 51724,/1985 and 147511/1982.

The coloring layer may have a multilayer structure. On the coloring layer, there may be provided a lubricating layer or other coating layer. The coloring layer or the top layer of the multilayer coloring layer may contain the fluorine-containing moisture-curing resin, the siloxane-containing moisture-curing resin, silicone materials, fluorine-containing materials, or antistatic agents, to prevent the thermal fusion of the coloring layer to the dyeing layer during printing.

FIGS. 16 to 23 illustrate the cross sections of various embodiments of the intermediate sheet used in the thermal transfer printing method according to the present invention.

Figure 18:
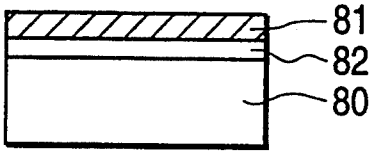
Figure 19:
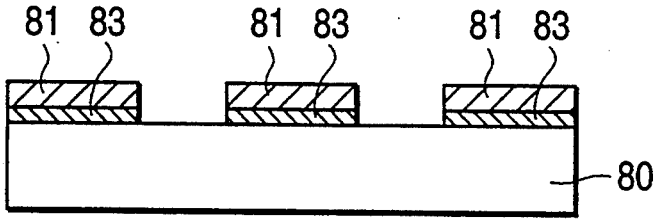
Figure 20:
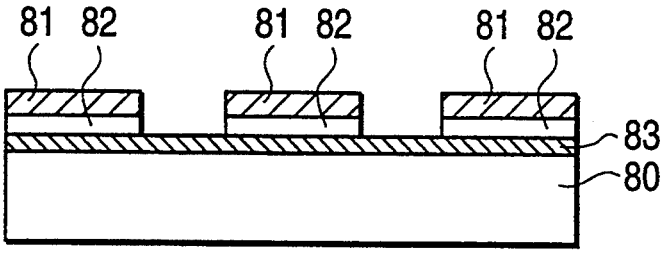

The intermediate sheet may comprise a substrate 80 and a dyeing layer 81, or the substrate 80, a polymer layer 82 and the dyeing layer 81 as shown in FIG. 18. In addition, it may comprise the substrate 80, a releasing layer 83 and the dyeing layer 81 as shown in FIG. 19, or the substrate 80, the releasing layer 83, the polymer layer 82 and the dyeing layer 81 as shown in FIG. 20. Further, it may comprise the substrate 80, a fixing layer 85 and the dyeing layer 81.

Figure 17:
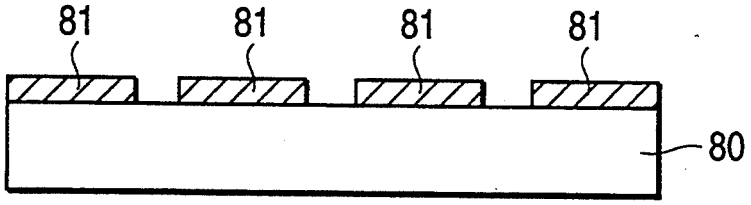

Each of FIGS. 17, 19 and 20 shows a part of the elongate intermediate sheet on which plural dyeing layers and the like are formed discretely. The dyeing layer may also be formed continuously over the surface of elongate substrate.

Figure 21:
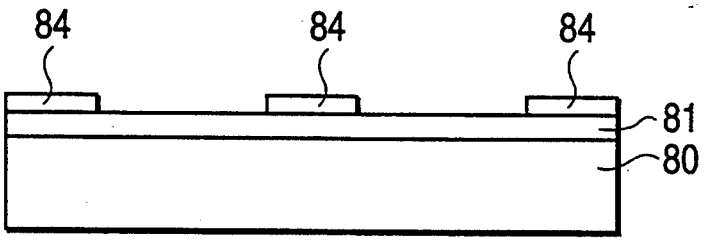

As shown in FIG. 21, a masking layer (a covering layer) 84 is discretely formed over the continuously formed dyeing layer, and parts of the dyeing layer having no masking layer thereover are transferred to the image receptor.

FIGS. 19 and 20 show the discretely or continuously formed releasing layers, respectively. The present invention is not limited to these embodiments.

If the releasing layer in FIG. 20 contains a sticking agent and its sticking property may cause some troubles when the intermediate sheet is wound, the masking layers are formed over the exposed surfaces of the releasing layers to prevent the exposure of the releasing layers having the sticking property.

Figure 22:
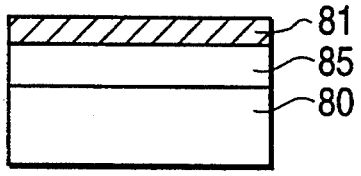
Figure 23:
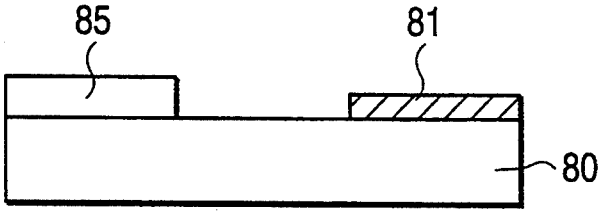

In the intermediate sheets of FIGS. 22 and 23, the dyeing layer may be the same as those in FIGS. 16 to 21.

The dyeing layer 81 contains a polymer. If necessary, the dyeing layer may contain a color developer such as an electron acceptor, for example, when a leuco dye is used in the coloring layer. Examples of the electron acceptor are phenol compounds such as bisphenol A, carboxylic acid compounds, silica, activated china clay, and the like.

The kind of polymer contained in the dyeing layer is not limited. For example, the polymers exemplified in connection with the binder for the coloring layer can be used. Namely, examples of the polymer are acrylic resins, polystyrene resins, polyurethane resins, polyester resins, polyvinyl acetal resins, polyvinyl acetate resins, polyamide resins, cellulose resins, chlorinated resins, and the like. In particular, acrylonitrile-styrene copolymer resins, polystyrene, styrene-acryl copolymer resins, saturated polyester, polyester-urethane, chlorinated rubber, chlorinated polypropylene, polyvinyl chloride resins, chlorinated polyvinyl chloride resins, vinyl chloride-vinyl acetate copolymer resins which may include an other copolymerizable monomer such as vinyl alcohol, maleic acid, etc., vinyl chloride-acrylate copolymer which may comprise two or more acrylates, polyvinyl acetate resins, polycarbonate, cellulose resins or mixtures thereof are preferred, since the printing sensitivity is extremely good.

Among the polymers, one having a glass transition temperature of 40° to 150° C., one having an average polymerization degree of 150 to 3000, or one having a flow temperature of not higher than 300° C. is preferred. For the purpose of transferring the dyeing layer to the image receptor, or fixing the dyeing layer in the fibers when the image receptor is made of paper or other porous material, a polymer having a small molecular weight with an average polymerization degree not larger than 2000, or having a flow temperature not higher than 250° C., is particularly preferred.

Since the dyeing layer having the formed image is transferred to the image receptor, the dyeing layer is preferably transparent. Therefore, the polymer having high transparency is more greatly preferred, and polyvinyl acetal is most suitable for the dyeing layer polymer. The polyvinyl acetal is a resin prepared by reacting polyvinyl alcohol with an aldehyde (e.g., formaldehyde, acetaldehyde, propionaldehyde, butylaldehyde, etc.) or a mixture of two or more aldehydes, and optionally an other reactive compound. Preferred examples of the polyvinyl acetal are polyvinyl formal, acetacetalated polyvinyl alcohol, propionacetalated polyvinyl alcohol, polyvinyl butyral and the like. The polyvinyl acetals disclosed in Japanese Patent Kokai Publication Nos. 65391/1991 and 162989/1991 can be used.

As an acetalation degree increases, the polyvinyl acetal has better properties of preventing the thermal fusion of the dyeing layer to the coloring layer, and a lower flow temperature, so that the dyeing layer has better transfer and fixing properties with the image receptor. Preferably, the acetalation degree is at least 50% by mole. In particular, when the butyralation degree of polyvinyl butyral is at least 40% by mole, preferably at least 50% by mole, the dyeing layer is excellent in the prevention of thermal fusion to the coloring layer, printing sensitivity and transfer and fixing characteristics. Examples of preferred polyvinyl acetal are BL-1 (butyralation degree of 63±3% by mole, flow temperature of 105° C.), BL-2 (butyralation degree of 63±3% by mole, flow temperature of 120° C.), BH-S (butyralation degree of 70% by mole or larger, flow temperature of 160° C.), BM-S (butyralation degree of 70% by mole or larger, flow temperature of 150° C.), BL-S (butyralation degree of 70% by mole or larger, flow temperature of 110° C.), BH-3 (butyralation degree of 65±3% by mole, flow temperature of 205° C.), BM-2 (butyralation degree of 68±3% by mole, flow temperature of 140° C.), BM-1 (butyralation degree of 65±3% by mole, flow temperature of 130° C.) and BM-5 (butyralation degree of 65±3% by mole, flow temperature of 160° C.), and BL-3 (flow temperature of 105° C.), all of which are trade names of Sekisui Chemical Co., Ltd.

The polyvinyl acetal may be reacted with a phenol resin, an epoxy resin, a melamine resin, an isocyanate compound or a dialdehyde compound to form a cross-linking structure.

When the dyeing layer is formed using at least one resin selected from the group consisting of the fluorine-containing moisture-curing resins and the siloxane-containing moisture-curing resins, it is excellent in the prevention of thermal fusion to the coloring layer, so that it is not fusion bonded to the coloring layer in the thermal transfer printing step.

The fluorine-containing moisture-curing resins and the siloxane-containing moisture-curing resins are the same as those explained in connection with the transfer sheet.

When the dyeing layer contains the polyvinyl acetal having the excellent thermal fusion prevention properties and the fluorine-containing moisture-curing resin or the siloxane-containing moisture-curing resin, it is particularly excellent in the prevention of thermal fusion to the coloring layer.

The polymer layer 82 is formed from at least one polymer material. The kind of polymer is not critical, and may be selected from thermoplastic resins, and resins which can be cured by heat, light or electron beam. For example, acrylic resins, polyurethanes, polyamides, polyesters, celluloses, polystyrene, polyolefins, and the like are used. Among them, acrylonitrile-styrene copolymer resins, polystyrene, styrene-acryl copolymer resins, chlorinated rubber, chlorinated polypropylene, polyvinyl chloride resins, chlorinated polyvinyl chloride resins, polyvinyl acetate resins, vinyl chloride-vinyl acetate resins, vinyl chloride-acetate copolymer resins, saturated polyesters, polyester urethane, polyvinyl acetal, polyvinyl alcohol, cellulose derivatives, modified starches, starch derivatives, polycarbonate, or mixtures thereof are preferred. In particular, when the polymer layer is formed using at least one polymer selected from the group consisting of polyvinyl alcohol, a polyvinyl alcohol derivative, the cellulose derivative, the modified starch, the starch derivative, the chlorinated resin and polycarbonate, it has good solvent resistance when a dyeing layer paint containing a solvent such as an aromatic solvent (e.g., toluene, etc.) or a ketone solvent (e.g., 2-butanone, etc.) is applied. In addition, the adhesion strength of such a polymer to the polyester film, which is one of the typical substrates is not so strong, so that the polymer layer can be easily removed from the polyester film.

The polyvinyl alcohol derivatives include polyvinyl acetals, which may be the same as those exemplified in connection with the dyeing layer. The cellulose derivatives include methylcellulose, ethylcellulose, hydroxyethylcellulose, carboxymethylcellulose, nitrocellulose and cellulose acetate. The modified starches include oxidized starch or enzyme-modified starch. The starch derivatives include hydroxyethyl starch, carboxymethyl starch and cyanoethylated starch. The chlorinated resins include chlorinated polyethylene and chlorinated polypropylene.

In view of the storage reliability of the printed image, preferably the polymer has a glass transition temperature of at least 50° C.

Preferably, the polymer in the polymer layer has a glass transition temperature higher than that of the polymer in the dyeing layer. That is, when the dyeing layer, which is transferred to the image receptor, is fixed by the heated fixing roll, the colorant in the dyeing layer tends to stain the fixing roll if the temperature of the fixing roll is high. When the polymer in the polymer layer has a higher glass transition temperature than that of the polymer in the dyeing layer, the fixing roll is not stained.

When a sheet of paper is used as the image receptor, the polymer preferably has an average polymerization degree of 150 to 3000, or a flow temperature of 80° to 300° C., since such a polymer has good penetrability in the spaces among the paper fibers. In particular, a polymer having an the average polymerization degree of 2000 or smaller, or a flow temperature of 250° C. or lower, is preferred.

When the polymer layer 82 contains the polymer and at least one resin selected from the group consisting of the fluorine-containing moisture-curing resins and the siloxane-containing moisture-curing resins, or the releasing agent used in the releasing layer, the releasability of the polymer layer from the substrate of the intermediate sheet is easily controlled.

The material forming the releasing layer 83 is not limited. For example, the releasing layer has excellent releasability when it is formed from at least one resin selected from the group consisting of the fluorine-containing moisture-curing resins and the siloxane-containing moisture-curing resins. The releasing layer may be formed from the polymer and at least one resin selected from the group consisting of the fluorine-containing moisture-curing resins and the siloxane-containing moisture-curing resins. Alternatively, the releasing layer may contain a resin which is cured by heat, light or electron beam, and has good adhesion to the substrate of intermediate sheet. Further, the releasing layer may be formed from at least one of the following releasing agents and the polymer.

Examples of silicone releasing agents ace silicone oils with good stability such as dimethylsilicone oil, phenylsilicone oil, fluorosilicone oil, etc.; reactive or modified silicone oils such as SiH-modified, silanol-modified, alkoxy-modified, epoxy-modified, amino-modified, carboxyl-modified, alcohol-modified, mercapto-modified, vinyl-modified, polyether-modified, fluorine-modified, higher fatty acid-modified, carnauba wax-modified, amide-modified, or alkylallyl-modified silicone oils; heat vulcanizable, room temperature curing, or liquid silicone rubbers; condensation reaction, addition reaction, peroxide-curing, or UV light-curing silicone resins; silicone emulsions; silicone resin powders; silicone rubber powders; and the like.

Examples of fluorine-containing releasing agents are fluororesins such as polytetrafluoroethylene and tetrafluoroethylene-perfluoroalkyl vinyl ether copolymers; fluororubbers such as vinylidene fluoride-hexafluoropropylene copolymers; fluorine-containing surfactants; fluorinated carbons; fluororubber latexes; and the like.

In addition, aliphatic acid esters, waxes and oils may be useful as the releasing agents.

The curable resins include polyol acrylate, polyester acrylate, polyepoxy acrylate, polyurethane acrylate, silicone acrylate, spiroacetate resin, phosphazene resin, epoxy resin, melamine resin, acrylic resin, phenol resin, urethane resin, phenoxy resin, and the like. In particular, UV light-curing and/or electron beam-curing resins such as oligoacrylate and epoxy resins are preferred.

As the releasing layer, a combination of the curable resin which is cured by light or electron beam and the reactive or modified silicone oil is preferred.

To control the releasability of the releasing layer, preferably the releasing layer contains the sticking agent and/or fine particles (ultrafine particles). For example, a composition comprising the curable resin, the reactive or modified silicone oil and the sticking agent, or a composition comprising the condensation reaction, addition reaction or UV light-curing silicone resin and the silicone sticking agent is preferred.

When the releasing layer 83 contains the polymer, any of the resins which are explained in connection with the polymer layer 82 may be used. If necessary, the above releasing agent may be used in combination with the polymer.

An adhesive layer may be present between the substrate and the releasing layer.

Preferably, the releasing layer is formed from a releasing rubber having a rubber hardness of 90° or less, since it has a function of fixing the dyeing layer on the image receptor when the dyeing layer is transferred from the intermediate sheet to the image receptor.

The fixing layer 85 may be a fine particle-containing layer or an elastic or releasing elastic layer, which decreases the gloss of the transferred layer, such as the dyeing layer, which is transferred onto the image receptor.

When the fixing layer 85 is laminated on the substrate 80 together with the dyeing layer 81 as shown in FIG. 22, it should contain at least the sticking agent and/or the fine particles so that the dyeing layer is held to prevent transfer of the dyeing layer to the transfer sheet in the printing step in which the thermal transfer image is printed in the dyeing layer using the transfer sheet.

The elastic layer is preferably formed from the elastic material having the rubber hardness of 90° or less. Examples of the elastic material are the natural rubbers and the synthetic rubbers such as silicone rubbers, fluororubbers, and polyurethane rubbers which are explained in connection with the elastic material of the medium for applying heat and/or pressure in the method of FIG. 1.

As the elastic material, thermoplastic elastomers such as polyurethane, polyester, polyolefin, polystyrene, polyamide, fluoropolymer, or foam materials may be used.

Preferably, the fixing layer has releasability on its surface, so that it can be easily removed from the fixed dyeing layer on the image receptor after the dyeing layer is fixed on the image receptor.

The fixing layer may have a releasing layer on its top surface.

To impart the releasability to the fixing layer or to form the releasing layer on the fixing layer, the materials which are explained in connection with the releasing layer 83 can be used.

As in the case of the releasing layer 83, the fixing layer 85 preferably contains the sticking agent and/or the fine particles to control its surface releasability. Using the fine particles contained in the fixing layer, the surface of the dyeing layer is roughened and surface gloss of the dyeing layer is decreased when the dyeing layer is fixed on the image receptor.

The thickness of the fixing layer 85 is preferably from 0.5 to 100 μm, through a the thickness outside this range may be used.

When the fixing layer contains the fine particles, the gloss is effectively decreased, even if the thickness of the fixing layer is small.

Preferred examples of the fine particles are synthetic amorphous silica, titanium oxide, calcium carbonate, alumina, talc, and the like. Along with the fine particles, a coupling agent such as a silane coupling agent may be used.

When the dyeing layer 81 is, or the dyeing layer 81 and the polymer layer 82 are, fixed on the sheet of paper and impregnated in the spaces among the fibers, the writing properties on the paper surface are good. To control the writing properties, the dyeing layer or the polymer layer may contain fine particles such as synthetic amorphous silica, titanium oxide, calcium carbonate, alumina and talc, or transparent fine particles.

To improve the light resistance of the image, the dyeing layer or the polymer layer may contain a UV light absorber, an antioxidant or a fluorescent agent.

Since the image is formed in the dyeing layer 81 of the intermediate sheet, and then the dyeing layer 81 is, or the dyeing layer and the polymer layer 82 are, transferred to the image receptor, the dyeing layer is preferably transparent. To this end, the polymer having high transparency is preferably used.

The polymer layer 82 may be a layer which dyes or color develops the colorant in the coloring layer of the transfer sheet.

The coloring layer, the dyeing layer or the polymer layer may contain at least one releasing agent. As the releasing agent, the silicone materials or the fluorine-containing materials which are explained in connection with the releasing layer 27 can be used. In particular, the reactive or modified silicone oil or oils can be preferably used.

The dyeing layer, the polymer layer or the releasing layer may contain an antistatic agent, or other additives.

The image receptor may comprise non-coated paper, coated paper, a film, a sheet, a transparent film which may be used in over head projection, bond paper having a large surface roughness, synthetic paper, and the like, and may be continuous or cut.

When the image receptor is made of plain paper such as wood free paper, a medium quality paper, a low quality paper, bond paper or post card, the fixing of the image receptor which is transferred to the dyeing layer decreases the gloss of the dyeing layer part, so that the presence of the dyeing layer on the paper is less visible. Therefore, a parts of the paper surface on which the dyeing layer is present and other parts of paper surface on which no dyeing layer is present can hardly be usually distinguished and the printed image has desirable qualities on the plain paper. This is also true when the laminate of the dyeing layer and the polymer layer is transferred to and fixed on the image receptor.

When the intermediate sheet has the fixing layer between the dyeing layer and the substrate as shown in FIG. 22, or the releasing layer 83 in FIG. 19 is the releasing elastic layer, the fixing of dyeing layer on the image receptor is carried out at the same time as the transfer of the dyeing layer to the image receptor, whereby an image having a low gloss is also obtained.

The image printed in the dyeing layer of the intermediate sheet is a left-right reverse image (a mirror image), since the image in the dyeing layer is transferred to and fixed on the image receptor. Then, the image is printed in the dyeing layer of the intermediate sheet by taking this left-right reversal of the image into consideration.

In the thermal transfer printing method according to the present invention, the dyeing layer on which the image is printed may be once transferred to the intermediate medium and then transferred to and fixed on the image receptor.

As explained above, by fixing the dyeing layer, which is transferred to the image receptor, on the image receptor using the medium for applying heat and/or pressure, the gloss on the image receptor is greatly decreased, in particular when the image receptor is fibrous such as plain paper, since the dyeing layer is injected in the spaces between the fibers. The obtained image thereby has substantially the same appearance and hand feel as the plain paper.

Since the medium for applying heat and/or pressure, which is used for transferring the image, is also used in fixing the dyeing layer on the image receptor, the printing method and apparatus can be made simple.

Since the dyeing layer of the intermediate sheet should be transferred to the image receptor, it cannot be firmly adhered to the substrate of the intermediate sheet. As a result, when the sublimation type thermal transfer image is printed in the dyeing layer, the coloring layer of the transfer sheet and the dyeing layer of the intermediate sheet are softened or made molten, so that the dyeing layer tends to be transferred to the coloring layer. According to one embodiment of the present invention, the image is printed in the dyeing layer while maintaining the intermediate sheet on the belt, and the laminated transfer sheet and the intermediate sheet are conveyed for a sufficient time for cooling the coloring layer and the dyeing layer after printing the sublimation type thermal transfer image in the dyeing layer. Since the transfer sheet is delaminated from the intermediate sheet after they are sufficiently cooled, the dyeing layer is not transferred to the coloring layer of the transfer sheet.

In addition, when the intermediate sheet is maintained on the belt, cooling of the intermediate sheet is accelerated after the printing, whereby a stable image is obtained even in high speed printing.

In particular, when the cut intermediate sheet is maintained on the belt and the image is printed in the dyeing layer of the intermediate sheet, the printing speed is further increased by the stable travel of the cut intermediate sheet.

Since the dyeing layer is transferred to and fixed on the image receptor using the media for applying heat and/or pressure by maintaining the intermediate sheet on the belt, wrinkling of the image receptor under the medium for applying heat and/or pressure is prevented, and conveying of the intermediate sheet and/or the image receptor before and after transfer of the dyeing layer becomes easy.

When the elongate intermediate sheet is used, the handling of the intermediate sheet in the feeder section is easy. In addition, when the elongate intermediate sheet is cut in a suitable step of the thermal transfer printing method, the printing and transfer can be carried out at the same time so that the printing speed is significantly increased.

When the front edge part of the intermediate sheet extends beyond the front edge of the image receptor in the laminated state, the intermediate sheet can be easily delaminated from the image receptor either manually or mechanically, whereby the dyeing layer is easily transferred to the image receptor.

When the cut intermediate sheet is used, the medium for applying heat and/or pressure which is used in the transfer step can be also used in the fixing step, so that the apparatus is made simple.

When the intermediate sheet has the dyeing layer and the fixing layer on the substrate, the dyeing layer which is transferred to the image receptor is fixed by the fixing layer, so that the obtained image has a greatly suppressed surface gloss.

PREFERRED EXAMPLES OF THE INVENTION

The present invention will be illustrated in more detail by the following examples, in which "parts" are by weight.

Example 1

Preparation of Transfer Sheet

On an anchor coat of a polyethylene terephthalate (PET) film having a width of 200 mm and a thickness of 5 μm, and a heat resistant lubricating layer on its lower surface and an anchor coat on its upper surface, the following three color coating paints were successively coated at a coating length of 300 mm and a distance between the color coatings of 10 mm, to form the color layers each having a thickness of about 1 μm. Between the adjacent color coating layers, black marks were printed at different positions.

| | Parts |
|---|---|
| Cyan color coating paint | |
| Indoaniline disperse dye | 3.5 |
| Acrylonitrile-styrene copolymer resin | 4 |
| Amido-modified silicone oil | 0.04 |
| Titanium oxide (T 805. Nippon Aerosil Co., Ltd.) | 0.24 |
| Toluene | 25 |
| 2-Butanone | 25 |
| Magenta color coating paint | |
| Azo disperse dye | 3 |
| Acrylonitrile-styrene copolymer resin | 4 |
| Amido-modified silicone oil | 0.04 |
| Titanium oxide (T 805) | 0.24 |
| Toluene | 25 |
| 2-Butanone | 25 |
| Yellow color coating paint | |
| Dicyanomethine disperse dye | 3 |
| Acrylonitrile-styrene copolymer resin | 4 |
| Amido-modified silicone oil | 0.04 |
| Titanium oxide (T 805) | 0.24 |
| Toluene | 25 |
| 2-Butanone | 25 |

Preparation of Intermediate Sheet

On an elongate PET film having a width of 190 mm and a thickness of 12 μm, a coating paint containing a polyvinyl butyral resin (BL-S manufactured by Sekisui Chemical Co., Ltd., an average polymerization degree: about 350) (4 parts), a siloxane-containing acrylsilicone resin solution (F-6A manufactured by Sanyo Chemical Industries, Ltd., a content of the effective component: 54% by weight) (0.24 part), di-n-butyltin dilaurate (0.001 part), toluene (18 parts) and 2-butanone (18 parts) was coated and dried to form dyeing layers each having a length of 250 mm and a dry thickness of 3 μm, leaving a non-coated area of 100 mm between the adjacent dyeing layers to obtain an elongate intermediate sheet having plural dyeing layers.

Thereafter, the image was printed using the apparatus of FIG. 1.

The transfer sheet was set in a suitable feeding means such as a cassette and used as the transfer sheet 2 of FIG. 1.

The elongate intermediate sheet was cut to a length of 350 mm to placing the dyeing layer at the center, and the cut intermediate sheets were set in the intermediate sheet feeder 5 of FIG. 1 the dyeing layer facing downward. The cut intermediate sheet was fed on the platen 7, and its front edge was held by the chuck. The platen was rotated, so that the intermediate sheet was wound around the platen 7.

First, the intermediate sheet and the transfer sheet were positioned by sensing the black mark on the transfer sheet and the rotation position mark on the platen, so that the dyeing layer and the yellow coloring layer were laminated. The printing head was pressed to the platen under pressure of about 3 kg, and an image was printed while rotating the platen in the counterclockwise direction under the following printing conditions:

Printing speed: 4 msec./line

Printing pulse width: 0.2 to 3.8 msec.

Maximum printing energy: 5 J/cm$^2$

Next, in the dyeing layer in which the yellow image had been printed, an image was printed using the magenta color layer in the same manner as above.

Finally, the cyan image was printed in the dyeing layer on which the yellow image and the cyan image had been printed, in the same manner as above.

After printing, the intermediate sheet was removed by its tail end from the platen using the separation nail, and forwarded on the conveying belt 11. When the front edge of the intermediate sheet approached the separation nail, the chuck was opened.

Then, the intermediate sheet traveled by the conveying belt 11 to just before the driving rolls 12 and 13, and a sheet of wood free paper of A4 size, which was fed from the image receptor feeder 14, was laminated on the intermediate sheet, extending the side edge parts of the intermediate sheet beyond the respective side edges of the sheet of wood free paper by substantially the same distances. The laminated intermediate sheet and the paper sheet were passed between the driving rolls 12 and 13, and between the metal roll 20, which was heated to a surface temperature of about 120° C. by the built-in halogen lamp (a roll length of 250 mm, a diameter of 30 mm), and the silicone rubber-coated metal roll 21, which was heated to a surface temperature of about 120° C. by the built-in halogen lamp, (a roll length of 250 mm, a diameter of 30 mm, a rubber coating thickness of 2.5 mm, a rubber hardness of 20°) under, roll pressure of about 80 kg at a traveling speed of 20 mm/sec. Further, they were passed between the rolls 22 and 23, and the PET film was delaminated from the paper sheet by the separation guide 28 to transfer the dyeing layer onto the paper sheet. The PET film of the intermediate sheet was discharged in the tray 29.

The paper sheet carrying the transferred dyeing layer was moved by the conveying belt 19 and the driving roll 17 and again passed between the driving rolls 12 and 13, and then between the metal roll 20 heated to the surface temperature of about 140° C. and the silicone rubber-coated metal roll 21 heated to the surface temperature of about 140° C. under the roll pressure of about 150 kg at a traveling speed of 20 mm/sec., whereby the dyeing layer was fixed on the paper sheet.

The paper sheet on which the dyeing layer had been fixed was passed between the rolls 22 and 23 and between the the roll 26 and the separation guide 28, and discharged to the image receptor tray 25.

The fixed image on the sheet of wood free paper was a high quality image having a black reflection print density of 1.50 at the pulse width of 3.8 msec. and uniform dots from the low print density to the high print density.

The surface gloss on the sheet of wood free paper carrying the fixed image was 5.8, and had good writing quality with a pencil.

Example 2

Transfer Sheet

The same transfer sheet as prepared in Example 1 was used.

Preparation of Intermediate Sheet

On an elongate PET film having a width of 190 mm and a thickness of 12 μm, a coating paint containing an epoxyacrylate resin (SP-5003 manufactured by Showa High Polymer Co., Ltd.) (5 parts), a photopolymerization initiator (IRGACURE (trademark) 184 sold by Ciba-Geigy (Japan) Ltd.) (0.15 part), a sticking agent (YP Resin Px, #300 manufactured by Yasuhara Yushi Kogyo Co., Ltd.) (2.14 parts), a silicone releasing agent (X-62-5039 manufactured by Shinetsu Chemical Co., Ltd., a silicone content of 30% by weight) (1.19 parts), a catalyst (CAT-PL-500 manufactured by Shin-etsu Chemical Co., Ltd.) (0.06 part) and cyclohexanone (50 parts) was coated and cured using a high pressure mercury lamp to form weakly tacky releasing layers each having a length of 260 mm and a dry thickness of about 0.5 μm, leaving a non-coated area of 90 mm between the adjacent releasing layers. On only the releasing layers a coating paint containing a polyvinyl acetal resin (BL-3 manufactured by Sekisui Chemical Co., Ltd., an average polymerization degree: about 300) (4 parts), a siloxane-containing acrylsilicone resin solution (F-6A) (0.37 part), di-n-butyltin dilaurate (0.002 part), toluene (18 parts) and 2-butanone (18 parts) were coated and dried to form dyeing layers each having a length of 250 mm and a dry thickness of about 2 μm, to obtain an elongate intermediate sheet having plural dyeing layers.

Thereafter, the image was printed in the dyeing layer, and the dyeing layer was transferred to and fixed on the sheet of wood free paper using the apparatus of FIG. 1 in substantially the same manner as in Example 1. In this Example, only the dyeing layer was transferred to the sheet of wood free paper, and the PET film carrying the weakly tacky releasing layers was discharged to the tray 29.

The fixed image on the sheet of wood free paper, which was discharged to the image receptor tray 25, was a high quality image having a black reflection print density of 1.55 at the pulse width of 3.8 msec. and uniform dots from the low print density to the high print density.

The surface gloss on the sheet of wood free paper carrying the fixed image was 5.5, and had good writing quality with a pencil.

Example 3

Transfer Sheet

The same transfer sheet as prepared in Example 1 was used.

Preparation of Intermediate Sheet

On an elongate PET film having a width of 190 mm and a thickness of 12 μm, a coating paint containing a releasing silicone resin (SD 7328 manufactured by Toray Dow Corning Silicone Co., Ltd., a resin content:

about 30% by weight) (5 parts), an addition reaction silicone tackifier (SD 4570 manufactured by Toray Dow Corning Silicone Co., Ltd., a resin content: about 30% by weight) (5 parts), a catalyst (SRX 212 manufactured by Toray Dow Corning Silicone Co., Ltd.) (0.1 part) and toluene (20 parts) were coated and heat treated at about 120° C. for 10 seconds to form weakly tacky releasing layers each having a length of 260 mm and a dry thickness of about 0.5 μm, leaving a non-coated area of 90 mm between the adjacent releasing layers.

On only the releasing layers a coating paint containing an acetacetalated polyvinyl alcohol (KS-0 manufactured by Sekisui Chemical Co., Ltd., an average polymerization degree: about 300; an acetacetalation degree: about 70% by mole or larger) (4 parts), a siloxane-containing acrylsilicone resin solution (F-6A) (0.4 part), di-n-butyltin dilaurate (0.002 part), toluene (36 parts) and 2-butanone (36 parts) were coated and dried to form dyeing layers each having a length of 250 mm and a dry thickness of about 1.5 μm to form the polymer layers. Each polymer layer was formed so that its center line was aligned on the center line of the respective releasing layer.

On the polymer layers, the same dyeing layer coating paint as used in Example 1 was coated and dried to form the dyeing layers each having the same length as the polymer layer and a dry thickness of about 1.5 μm, to form the elongate intermediate sheet having the three-layer structure consisting of the weakly tacky releasing layer, the polymer layer and the dyeing layer.

Thereafter, the image was printed in the dyeing layer using the apparatus of FIG. 5.

The elongate intermediate sheet prepared in the above was wound to provide the unwinding roll 40. The intermediate sheet was wound with the three-layer structure facing inside.

From the unwinding roll 40, the intermediate sheet 41 was fed by the feeding roll 3 to the position of the platen 7 having a diameter of 15 mm.

On the rotating belt 43, a silicone tackifier layer having a 180 degree peeling strength of 30 g/12 mm was coated in a length of 10 mm in the longitudinal direction of the belt from the line, which was 10 mm before the position where the front edge of the intermediate sheet and the rotating belt 43 contacted. Therefore, the intermediate sheet was adhered and held on the rotating belt 43 at the position 10 mm inside from its front edge.

By synchronously rotating the feeding roll 3 and the rotating belt 43, the intermediate sheet was forwarded on the rotating belt 43. The elongate intermediate sheet sheet was cut by the cutter 42 at the position which was 350 mm from its front edge. The rotating belt was made of an antistatic finished polyimide film having a thickness of about 50 μm.

First, the intermediate sheet and the transfer sheet were positioned by sensing the black mark on the transfer sheet and the mark on the rotating belt, so that the dyeing layer and the yellow coloring layer were laminated. Then, the thermal head was pressed to the platen under pressure of about 3 kg, and an image was printed while rotating the platen 7 and the roll 45 in the clockwise direction under the same printing conditions as in Example 1.

Next, in the dyeing layer in which the yellow image had been printed, images were printed using the magenta color layer and then the cyan color layer in the same manner as above.

After printing the images, the intermediate sheet was removed from the rotating belt 43 by the separation nail 9 and the driving roll 12, and forwarded to the entrance of the metal roll 20 (having a roll length of 250 mm and a diameter of 30 mm), which had no built-in heater and was heated by contacting it with the silicone rubber-coated metal roll 21, and the silicone rubber-coated metal roll 21 which was the same as used on Example 1.

At this position, a sheet of bond paper (cotton content: 25%) of A4 size which was fed from the image receptor feeder 14 was laminated on the intermediate sheet in the same configuration as in Example 1. The laminated intermediate sheet and the paper sheet were passed between the metal roll 20 and the silicone rubber-coated metal roll 21, which was heated to a surface temperature of about 120° C., with the surface temperature of the roll 20 being about 110° C., under a roll pressure of about 100 kg at a traveling speed of 20 mm/sec. Thereafter, at the interfaces between the weakly tacky releasing layer and the polymer layer, the PET film and the weakly tacky releasing layer were separated from the bond paper sheet by the separation guide, which was coated by a polytetrafluoroethylene film, whereby the dyeing layer and the polymer layer were transferred to the bond paper sheet.

The PET film carrying the weakly tacky releasing layer was discharged to the tray 29 by the driving roll 27.

The bond paper sheet carrying the transferred dyeing layer and polymer layer was moved by the conveying belt 19 to the entrance of the roll 20 and the silicone rubber-coating roll 21, and again passed between these rolls at the surface temperature of the roll 21 of about 150° C., with the surface temperature of the roll 20 being about 110° C., under a roll pressure of about 90 kg at a traveling speed of 20 mm/kg, whereby the dyeing layer and the polymer layer were pressed and fixed in the spaces among the paper fibers. Then, the fixed bond paper sheet was discharged in the image receptor tray 25 by opening the guide 24.

The fixed image on the bond paper sheet was a high quality image having a black reflection print density of 1.47 at the pulse width of 3.8 msec. and uniform dots from the low print density to the high print density.

The surface gloss on the bond paper sheet carrying the fixed image was 5.4, and had good writing quality with a pencil.

Example 4

Transfer Sheet

The same transfer sheet as used in Example 1 was used.

Preparation of Intermediate Sheet

On an elongate PET film having a width of 190 mm and a thickness of 12 μm, the same dyeing layer coating paint as used in Example 1 and a fixing layer coating paint having the following composition were coated to form a dyeing layer and a fixing layer side by side, leaving a non-coated area having a length of 300 mm, and heat treated at 100° C. for 20 seconds:

| Component | Parts |
|---|---|
| Releasing silicone resin (SD 7328) | 10 |
| Addition reaction silicone tackifier (SD 4570) | 10 |
| Catalyst (SRX 212) | 0.6 |

-continued

| Component | Parts |
|---|---|
| Toluene | 80 |

The dyeing layer has a thickness of 3 μm, a width of 170 mm and a length of 250 mm, and the fixing layer had a thickness of 40 μm, a width of 180 mm and a length of 260 mm.

Using the above prepared intermediate sheet and the transfer sheet, the dyeing layer was laminated on the yellow coloring layer of the transfer sheet, to print the yellow image under the following printing conditions:

Printing speed: 4 msec./line

Printing pulse width: 0.2 to 3.8 msec.

Maximum printing energy: 5 J/cm$^2$

In the same manner as above, the magenta and cyan color images were printed.

Then, on the dyeing layer having the printed images, a sheet of wood free paper was laminated.

The laminated intermediate sheet and the paper sheet were passed between the same metal roll as used in Example 1, which was heated to a surface temperature of about 120° C., and the silicone rubber-coated metal roll 21, which was heated to a surface temperature of about 120° C. by the built-in halogen lamp (the roll 21 having a roll length of 250 mm, a diameter of 30 mm, a rubber coating thickness of 2.5 mm, and a rubber hardness of 40°) under a roll pressure of about 80 kg at a traveling speed of 20 mm/sec. Then, the PET film was removed from the sheet of wood free paper to transfer the dyeing layer to the paper sheet.

Then, the sheet of wood free paper carrying the transferred dyeing layer was laminated on the intermediate sheet so that the transferred dyeing layer was laminated on the fixing layer of the intermediate sheet. They were again passed between the above metal roll and the silicone rubber-coated metal roll under a roll pressure of about 120 kg at a traveling speed of 20 mm/sec. at 130° C. Thereafter, the sheet of wood free paper was removed from the intermediate sheet. Since the fixing layer of the intermediate sheet had surface releasability, the sheet of wood free paper was easily removed from the intermediate sheet. By the above process, the dyeing layer was pressed and fixed in the spaces among the paper fibers.

The fixed image on the bond paper sheet was a high quality image having a black reflection print density of 1.50 at the pulse width of 3.8 msec. and uniform dots from the low print density to the high print density.

The surface gloss on the bond paper sheet carrying the fixed image was 6.1, and had a good writing quality with a pencil.

What is claimed is:

1. A thermal transfer printing method comprising the steps of:

laminating a transfer sheet, which comprises a substrate and a coloring layer on the substrate, on an intermediate sheet, which comprises a substrate and a dyeing layer on the substrate, so that the coloring layer and the dyeing layer contact each other;

pressing a printing head to the substrate of the transfer sheet to form a thermal transfer image in the dyeing layer;

delaminating the intermediate sheet carrying the image formed in the dyeing layer thereof from the transfer sheet;

laminating the intermediate sheet on an image receptor so that the dyeing layer carrying the image formed therein faces the image receptor;

transferring the dyeing layer carrying the image formed therein from the intermediate sheet to the image receptor by applying at least one of heat and pressure with a medium; and fixing the dyeing layer transferred to the image receptor on the image receptor with the medium used in said step of transferring.

2. A thermal transfer printing method comprising the steps of:

laminating a transfer sheet, which comprises a substrate and a coloring layer on the substrate, on an intermediate sheet, which comprises a substrate and a dyeing layer on the substrate, so that the coloring layer and the dyeing layer contact each other;

pressing a printing head to the substrate of the transfer sheet to form a thermal transfer image in the dyeing layer;

delaminating the intermediate sheet carrying the image formed in the dyeing layer thereof from the transfer sheet;

laminating the intermediate sheet on an image receptor so that the dyeing layer carrying the image formed therein faces the image receptor;

transferring the dyeing layer carrying the image formed therein from the intermediate sheet to the image receptor by applying at least one of heat and pressure while the intermediate sheet and the image receptor, laminated with each other, are held on a belt, with one of the intermediate sheet and the image receptor contacting the belt.

3. The thermal transfer printing method of claim 2, wherein the thermal transfer image is formed in the dyeing layer of the intermediate sheet in said step of pressing while the intermediate sheet is being held on a belt.

4. The thermal transfer printing method of claim 3, wherein the belt used in said step of transferring is the same belt used in said step of pressing, the belt conveying the intermediate sheet between a location at which said step of pressing takes place and a location at which said step of transferring takes place.

5. The thermal transfer printing method of claim 3, and further comprising the step of, after said step of transferring the dyeing layer from the intermediate sheet to the image receptor, fixing the dyeing layer transferred to the image receptor on the image receptor by applying one of heat and pressure thereto.

6. A thermal transfer printing method comprising the steps of:

laminating a transfer sheet, which comprises a substrate and a coloring layer on the substrate, on an intermediate sheet, which comprises a substrate and a dyeing layer on the substrate, so that the coloring layer and the dyeing layer contact each other;

pressing a printing head to the substrate of the transfer sheet to form a thermal transfer image in the dyeing layer while the intermediate sheet is being held on a belt;

delaminating the intermediate sheet carrying the image formed in the dyeing layer thereof from the transfer sheet;

laminating the intermediate sheet on an image receptor so that the dyeing layer carrying the image formed therein faces the image receptor; and transferring the dyeing layer carrying the image formed therein from the intermediate sheet to the image receptor by applying at least one of heat and pressure.

7. The thermal transfer method of claim 6, wherein said step of transferring is carried out by a medium for applying heat and pressure being pressed against the laminated intermediate sheet and image receptor.

8. The thermal transfer printing method of claim 6, and further comprising the step of, after said step of transferring the dyeing layer from the intermediate sheet to the image receptor, fixing the dyeing layer transferred to the image receptor on the image receptor by applying one of heat and pressure thereto.

9. The thermal transfer printing method of claim 8, and further comprising the step of, during said step of fixing the dyeing layer transferred to the image receptor on the image receptor, forming a subsequent thermal transfer image on another part of the dyeing layer of the intermediate sheet.

10. A thermal transfer printing method comprising the steps of:

laminating a transfer sheet, which comprises a substrate and a coloring layer on the substrate, on an elongate intermediate sheet, which comprises a substrate and a dyeing layer on the substrate, so that the coloring layer and the dyeing layer contact each other;

forming a thermal transfer image in the dyeing layer between a printing head and a platen by pressing the printing head towards the platen from the substrate side of the transfer sheet;

delaminating the intermediate sheet carrying the image formed in the dyeing layer thereof from the transfer sheet;

laminating the intermediate sheet on an image receptor so that the dyeing layer carrying the image formed therein faces the image receptor;

transferring the dyeing layer carrying the image formed therein from the intermediate sheet to the image receptor by applying at least one of heat and pressure with a medium, the medium including the platen; and cutting the elongate intermediate sheet at any point in said steps of said thermal transfer printing method.

11. The thermal transfer printing method of claim 10, wherein the elongate intermediate sheet is fed from an unwinding roll prior to said step of laminating.

12. A thermal transfer printing method comprising the steps of:

laminating a transfer sheet, which comprises a substrate and a coloring layer on the substrate, on an intermediate sheet, which comprises a substrate and a dyeing layer on the substrate, so that the coloring layer and the dyeing layer contact each other;

forming a thermal transfer image in the dyeing layer between a printing head and a platen by pressing the printing head towards the platen from the substrate side of the transfer sheet;

delaminating the intermediate sheet carrying the image formed in the dyeing layer thereof from the transfer sheet;

laminating the intermediate sheet on an image receptor so that the dyeing layer carrying the image formed therein faces the image receptor;

transferring the dyeing layer carrying the image formed therein from the intermediate sheet to the image receptor; and fixing the dyeing layer transferred to the image receptor on the image receptor;

wherein each of said steps of transferring and fixing employs a medium for applying at least one of heat and pressure in said steps of transferring and fixing, and wherein the medium comprises the platen in at least one of said steps of transferring and fixing.

13. The thermal transfer printing method of claim 12, wherein the medium comprises the platen in both of said steps of transferring and fixing, the medium applying at least one of heat and pressure to the laminated intermediate sheet and the image receptor in said step of transferring and to the image receptor having the dyeing layer thereon in said step of fixing.

14. A thermal transfer printing method comprising the steps of:

laminating a transfer sheet, which comprises a substrate and a coloring layer on the substrate, on an intermediate sheet, which comprises a substrate and a fixing layer and a dyeing layer on the substrate, so that the coloring layer and the dyeing layer contact each other;

pressing a printing head to the substrate of the transfer sheet to form a thermal transfer image in the dyeing layer;

delaminating the intermediate sheet carrying the image formed in the dyeing layer thereof from the transfer sheet;

laminating the intermediate sheet on an image receptor so that the dyeing layer carrying the image formed therein faces the image receptor;

transferring the dyeing layer carrying the image formed therein from the intermediate sheet to the image receptor by applying at least one of heat and pressure thereto;

laminating the intermediate sheet and the image receptor having the dyeing layer transferred thereto so that the fixing layer and the dyeing layer contact each other; and fixing the dyeing layer transferred to the image receptor on the image receptor by applying at least one of heat and pressure to the laminated intermediate sheet and the image receptor having the dyeing layer on the image receptor in contact with the fixing layer on the intermediate sheet.

15. A thermal transfer printing method comprising the steps of:

laminating a transfer sheet, which comprises a substrate and a coloring layer on the substrate, on an intermediate sheet, which comprises a substrate and a dyeing layer on the substrate, so that the coloring layer and the dyeing layer contact each other;

pressing a printing head to the substrate of the transfer sheet to form a thermal transfer image in the dyeing layer;

delaminating the intermediate sheet carrying the image formed in the dyeing layer thereof from the transfer sheet; and one of the following steps (a) and (b), step (a) comprising laminating the intermediate sheet on an image receptor so that the dyeing layer carrying the image formed therein faces the image receptor and so that the intermediate sheet has at least one edge part thereof that extends beyond a corresponding edge of the image receptor in a direction parallel with the laminated intermediate sheet and image receptor and integrating the intermediate sheet and the image receptor together by applying one of heat and pressure thereto, and step (b) comprising laminating the intermediate sheet on an image receptor so that the dyeing layer carrying the image formed thereon faces the image receptor and integrating the intermediate sheet and the image receptor together by applying at least one of heat and pressure thereto so that at least one edge part of the intermediate sheet extends beyond a corresponding edge of the image receptor in a direction parallel with the laminated intermediate sheet and image receptor.

16. The thermal transfer printing method of claim 15, and further comprising the step of, after the one of said steps (a) and (b), delaminating the substrate of the intermediate sheet from the image receptor to transfer the dyeing layer carrying the image formed thereon to the image receptor.

17. The thermal transfer printing method of claim 16, and further comprising the step of, after said step of transferring the dyeing layer from the intermediate sheet to the image receptor, fixing the dyeing layer transferred to the image receptor on the image receptor by applying one of heat and pressure thereto.

18. The thermal transfer printing method of claim 17, and further comprising the step of, during said step of fixing the dyeing layer transferred to the image receptor on the image receptor, forming a subsequent thermal transfer image on another part of the dyeing layer of the intermediate sheet.

19. A thermal transfer printing method comprising the steps of:

laminating a transfer sheet, which comprises a substrate and a coloring layer on the substrate, on an intermediate sheet, which comprises a substrate and a dyeing layer on the substrate, so that the coloring layer and the dyeing layer contact each other;

forming a thermal transfer image in the dyeing layer of the intermediate sheet between a printing head and a platen by pressing the printing head towards the platen from the substrate side of the transfer sheet while the intermediate sheet is held on the platen with a sticking agent;

delaminating the intermediate sheet carrying the image formed in the dyeing layer thereof from the transfer sheet;

laminating the intermediate sheet on an image receptor so that the dyeing layer carrying the image formed therein faces the image receptor; and transferring the dyeing layer carrying the image formed therein from the intermediate sheet to the image receptor by applying at least one of heat and pressure thereto.

20. The thermal transfer printing method of claim 19, and further comprising the step of, after said step of transferring the dyeing layer from the intermediate sheet to the image receptor, fixing the dyeing layer transferred to the image receptor on the image receptor by applying one of heat and pressure thereto.

21. The thermal transfer printing method of claim 20, and further comprising the step of, during said step of fixing the dyeing layer transferred to the image receptor on the image receptor, forming a subsequent thermal transfer image on another part of the dyeing layer of the intermediate sheet.

22. A thermal transfer printing method comprising the steps of:

laminating a transfer sheet, which comprises a substrate and a coloring layer on the substrate, on an elongate intermediate sheet, which comprises a substrate and a dyeing layer on the substrate, so that the coloring layer and the dyeing layer contact each other;

pressing a printing head to the substrate of the transfer sheet to form a thermal transfer image in the dyeing layer of the intermediate sheet;

delaminating the intermediate sheet carrying the image formed in the dyeing layer thereof from the transfer sheet;

laminating the intermediate sheet on an image receptor so that the dyeing layer carrying the image formed therein faces the image receptor;

transferring the dyeing layer carrying the image formed therein from the intermediate sheet to the image receptor by applying at least one of heat and pressure thereto; and cutting the elongate intermediate sheet at any one of the following points during the above said steps:

1) before said step of pressing the printing head to the substrate of the transfer sheet to form the thermal transfer image, 2) after said step of pressing the printing head to the substrate of the transfer sheet to form the thermal transfer image, 3) after said step of transferring the dyeing layer carrying the image formed therein from the intermediate sheet to the image receptor, and 4) during said step of pressing the printing head to the substrate of the transfer sheet to form the thermal transfer image.

23. The thermal transfer printing method of claim 22, and further comprising the step of, after said step of transferring the dyeing layer from the intermediate sheet to the image receptor, fixing the dyeing layer transferred to the image receptor on the image receptor by applying one of heat and pressure thereto.

24. The thermal transfer printing method of claim 23, and further comprising the step of, during said step of fixing the dyeing layer transferred to the image receptor on the image receptor, forming a subsequent thermal transfer image on another part of the dyeing layer of the intermediate sheet.

25. An apparatus for thermal transfer printing, comprising:

a feeding means for feeding an elongated intermediate sheet, the elongated intermediate sheet comprising a dyeing layer;

a cutting means for cutting the elongated intermediate sheet fed by said feeding means;

a printing means for printing and forming a thermal transfer image in the dyeing layer of the intermediate sheet fed by said feeding means; and transfer means for transferring the dyeing layer carrying the image formed therein from the intermediate sheet to an image receptor.

26. The thermal transfer apparatus of claim 25, and further comprising fixing means for fixing the dyeing layer transferred to the image receptor on the image receptor.

27. An apparatus for thermal transfer printing, comprising:

a feeding means for feeding a precut intermediate sheet, the intermediate sheet having a dyeing layer thereon;

a printing means for printing and forming a thermal transfer image in the dyeing layer of the intermediate sheet fed by said feeding means;

a transfer means for transferring the dyeing layer of the intermediate sheet fed by said feeding means and printed by said printing means and carrying the thermal transfer image formed therein to an image receptor; and a fixing means for fixing the dyeing layer transferred to the image receptor from the intermediate sheet by said transfer means on the image receptor.

28. An intermediate sheet for thermal transfer printing, comprising:

a substrate;

a fixing layer carried by said substrate, said fixing layer comprising an elastic material having a rubber hardness of no more than 90°; and a dyeing layer carried by said substrate.

29. The intermediate sheet of claim 28, wherein both said fixing layer and said dyeing layer are layered on said substrate at different locations on said substrate.

30. The intermediate sheet of claim 28, wherein said fixing layer is layered on said substrate, and said dyeing layer is layered on said fixing layer.

31. The thermal transfer printing method of any one of claims 1, 2, 3, 6, 12, and 14–19, wherein the intermediate sheet is a precut sheet.

32. The thermal transfer printing method of any one claims 1, 2, 3, 6, 12, and 14–19, wherein the intermediate sheet is elongate, and further comprising a step of cutting the intermediate sheet, said step of cutting taking place at any one point of the following points in said method:

1) before said step forming the thermal transfer image in the dyeing layer,
2) after said step forming the thermal transfer image in the dyeing layer,
3) after said step of laminating the intermediate sheet having the dyeing layer thereon with the image receptor,
4) after said step of transferring the dyeing layer from the substrate of the intermediate sheet to the image receptor, and
5) during said step printing the thermal transfer image on the dyeing layer of the intermediate sheet.

33. The thermal transfer printing method of any one of claims 1, 5, 12, and 14, and further comprising the step of, during said step of fixing the dyeing layer transferred to the image receptor on the image receptor, forming a subsequent thermal transfer image on another part of the dyeing layer of the intermediate sheet.

34. The thermal transfer printing apparatus of claim 26 or claim 27, wherein said means for transferring and said means for fixing have common components.

35. The thermal transfer printing apparatus of claim 25, 26 or 27, and further comprising a means for preventing wrinkling of the image receptor.

* * * * *